US011712914B1

(12) United States Patent
Wolter et al.

(10) Patent No.: US 11,712,914 B1
(45) Date of Patent: Aug. 1, 2023

(54) STAMPING KIT, COMPONENTS THEREOF, AND METHODS OF USE

(71) Applicant: Wolter Corp., Edgewood, NY (US)

(72) Inventors: Jeff Wolter, Commack, NY (US); Guy Tevel, Ramat-Gan (IL); John Kraljic, Riverhead, NY (US); Rita Pannulla, Patchogue, NY (US); Adam Wolter, Syosset, NY (US); James Caruso, Holbrook, NY (US); Allison Grynberg, Huntington Station, NY (US)

(73) Assignee: Wolter Corp., Edgewood, NY (US)

( * ) Notice: Subject to any disclaimer, the term of this patent is extended or adjusted under 35 U.S.C. 154(b) by 0 days.

(21) Appl. No.: 17/713,495

(22) Filed: Apr. 5, 2022

(51) Int. Cl.
*B41K 1/40* (2006.01)

(52) U.S. Cl.
CPC ..... *B41K 1/40* (2013.01)

(58) Field of Classification Search
CPC ... B41K 1/02; B41K 1/20; B41K 3/00; B41K 3/02; B41K 3/24; B41K 3/32; B41K 3/44; B41K 3/46; B41K 3/54; B41K 3/62; B41K 1/40
See application file for complete search history.

(56) References Cited

U.S. PATENT DOCUMENTS 808,422 A * 12/1905 Wilson et al. ..... B41K 1/20 33/622
880,883 A * 3/1908 Harton. ..... B41K 1/20 33/622
3,452,675 A * 7/1969 Whitelock ..... B41K 1/56 D18/15
2006/0101946 A1* 5/2006 Oh ..... B26F 1/36 76/107.1
2010/0085393 A1* 4/2010 Matsumoto ..... G07C 1/02 346/80
2011/0041662 A1* 2/2011 Lynen ..... B26F 1/36 83/684

FOREIGN PATENT DOCUMENTS

CN 210909719 * 7/2020
JP 2001-47722 * 2/2001

* cited by examiner

*Primary Examiner* — Christopher E Mahoney
*Assistant Examiner* — Marissa Ferguson-Samreth
(74) *Attorney, Agent, or Firm* — Carter, DeLuca & Farrell LLP; Paul J. Natof

(57) ABSTRACT

A stamping kit is disclosed. The stamping kit includes a jig, a card, and a plurality of stamps. The jig includes an upper surface, a lower surface, a front surface, a rear surface, a card slot, and a stamping slot. The card slot extends between he front surface and the rear surface, and defines a width and a height. The stamping slot extends between the upper surface and the card slot, and defines a width and a length. The card defines a width and a thickness, and is configured to slide within the card slot of the jig. Each stamp of the plurality of stamps has a proximal end configured to be engaged by a hammer, and a distal end having a character thereon. A distal portion of each stamp is configured and dimensioned to enter the stamping slot of the jig.

20 Claims, 27 Drawing Sheets

FIG.9
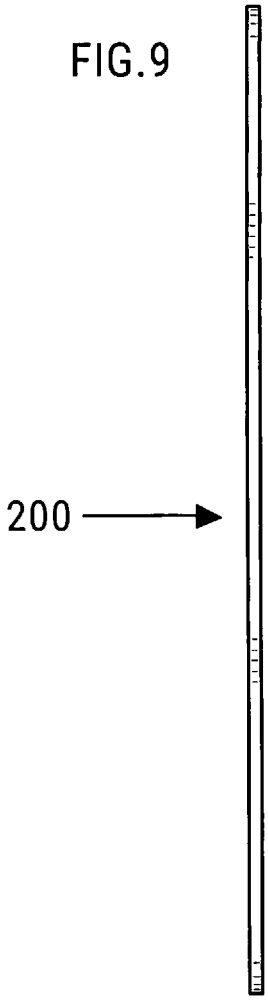
FIG.10
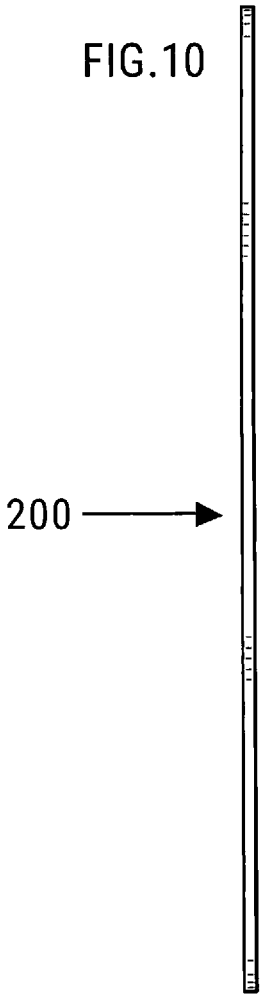
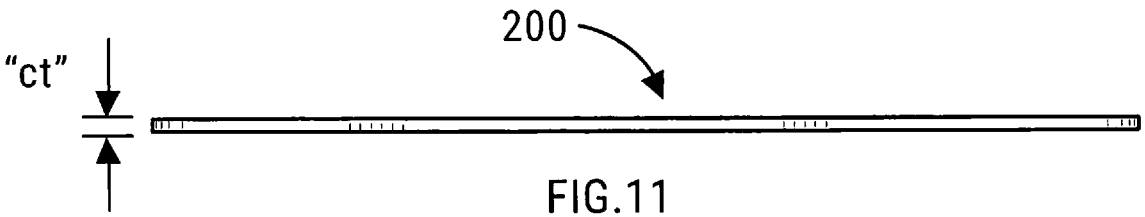
FIG.11
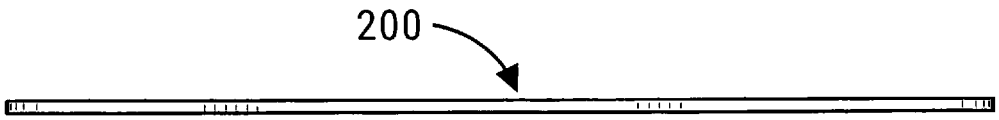
FIG.12

STAMPING KIT, COMPONENTS THEREOF, AND METHODS OF USE

BACKGROUND

The present disclosure relates to a stamping kit, components thereof, and methods of use. More particularly, the disclosure relates to a kit and its various components used to stamp or imprint characters or designs onto items such as metal cards, and associated methods.

Various types of stamping products are used to imprint letters or numbers onto metal cards, for instance. Such products may include a hammer, a plurality of stamps, and a substrate or blank on which to imprint the stamped design, for example.

When novices and experts alike attempt to stamp a particular series of characters using various stamps to form a word, name, or phrase, for instance, it may be challenging to perfectly align and space adjacent characters thereby resulting in a less-than-perfect final product. Moreover, it may also be challenging to properly imprint each character onto the blank or substrate, especially for beginners, as the stamps may slightly move, wander, or bounce while being hammered. As a result, the stamped blank may not only look amateurish, but the characters on the stamped blank may also be hard or impossible to decipher.

While imperfectly-stamped products such as jewelry or ornaments may be merely an aesthetic nuisance, imperfectly-stamped cards including passwords or seed words/phrases for cryptocurrency can be severely consequential.

More specifically, it is well known to back up passwords and passphrases onto a storage medium that is not connected to the internet or even to a computer, as computers are susceptible to fail at some point. While many people simply write down their passwords on paper, this method also has associated risks including misplacing the paper, fading ink, and fire, for instance. In certain situations, such as for various forms of cryptocurrency, it is impossible to recover lost passwords, seed words, or phrases.

Accordingly, a kit that allows or enables characters to be permanently and legibly imprinted onto a medium may be desirable.

SUMMARY

The present disclosure relates to a stamping kit. The stamping kit includes a jig, a card, and a plurality of stamps. The jig includes an upper surface, a lower surface, a front surface, a rear surface, a card slot, and a stamping slot. The card slot extends between he front surface and the rear surface, and defines a width and a height. The stamping slot extends between the upper surface and the card slot, and defines a width and a length. The card defines a width and a thickness, and is configured to slide within the card slot of the jig. Each stamp of the plurality of stamps has a proximal end configured to be engaged by a hammer, and a distal end having a character thereon. A distal portion of each stamp is configured and dimensioned to enter the stamping slot of the jig.

In disclosed embodiments, the width of the card slot of the jig is approximately equal to the width of the card.

It is also disclosed that the height of the card slot of the jig is approximately equal to the thickness of the card.

It is further disclosed that a length of the distal portion of each stamp of the plurality of stamps is approximately equal to the length of the stamping slot of the jig.

In disclosed embodiments, the jig includes a plurality of alignment marks disposed on the upper surface adjacent the stamping slot. In embodiments, each stamp of the plurality of stamps includes an alignment mark on the distal portion.

Additionally, it is disclosed that the jig includes between eight and 16 alignment marks disposed on the upper surface adjacent the stamping slot.

In disclosed embodiments, the jig includes a plastic layer, a steel layer, and a rubber layer.

It is further disclosed that an entirety of the card is made from titanium. In embodiments, the thickness of the card is 2 mm.

It is also disclosed that the stamping kit includes a hammer configured to individually engage the proximal end of each stamp of the plurality of stamps.

In embodiments, the card includes at least 12 enumerated lines.

The present disclosure also relates to a stamping kit including a card, a stamp, and a jig. The jig including a card slot and a stamping slot. The card slot is configured and dimensioned to allow the card to pass therethrough. The stamping slot is configured and dimensioned to allow a distal portion of the stamp to enter therein. The card slot is perpendicular to the stamping slot.

In disclosed embodiments, the card is made entirely from grade 3 commercial titanium. In embodiments, the card is 2 mm thick, and the card slot defines a height of about 2 mm.

It is also disclosed that the jig includes a plastic portion, a steel portion, and a rubber portion. In embodiments, the rubber portion is overmolded through part of the plastic portion and through part of the steel portion.

It is further disclosed that the card defines a width of about 3 inches, and the card slot of the jig defines a width of about 3 inches.

BRIEF DESCRIPTION OF THE DRAWINGS

Embodiments of the present disclosure are described hereinbelow with reference to the drawings wherein:

FIG. 9 is a right side view of the card of FIG. 6;

FIG. 10 is a left side view of the card of FIG. 6;

FIG. 11 is a front view of the card of FIG. 6;

FIG. 12 is a rear view of the card of FIG. 6;

DETAILED DESCRIPTION

Figure 1:
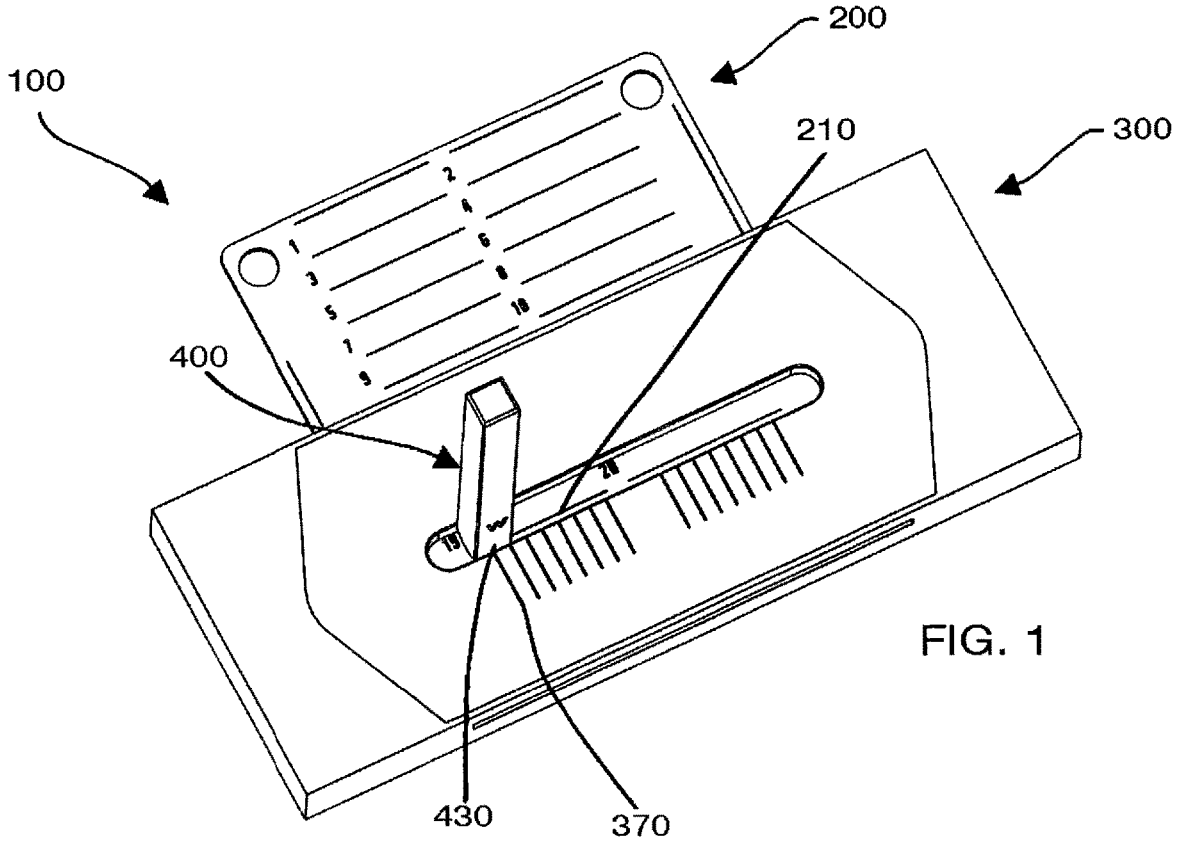
FIGS. 1-4 are various views of components of a stamping kit in accordance with the present disclosure.
Figure 2:
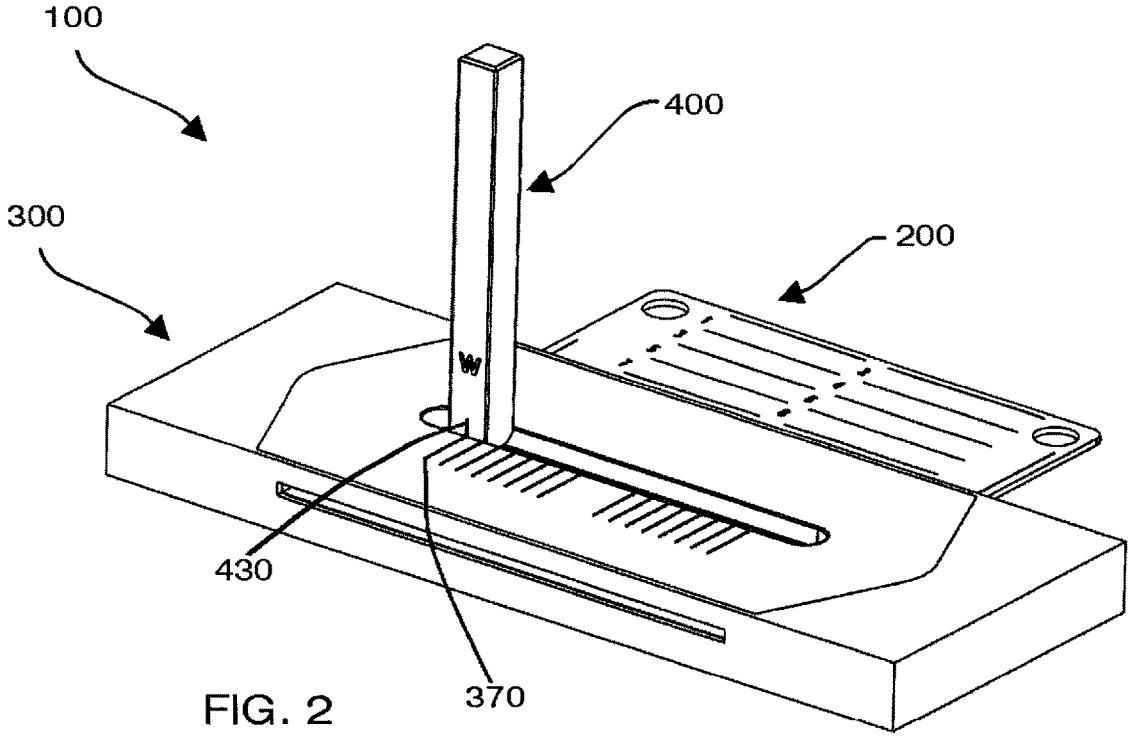
Figure 3:
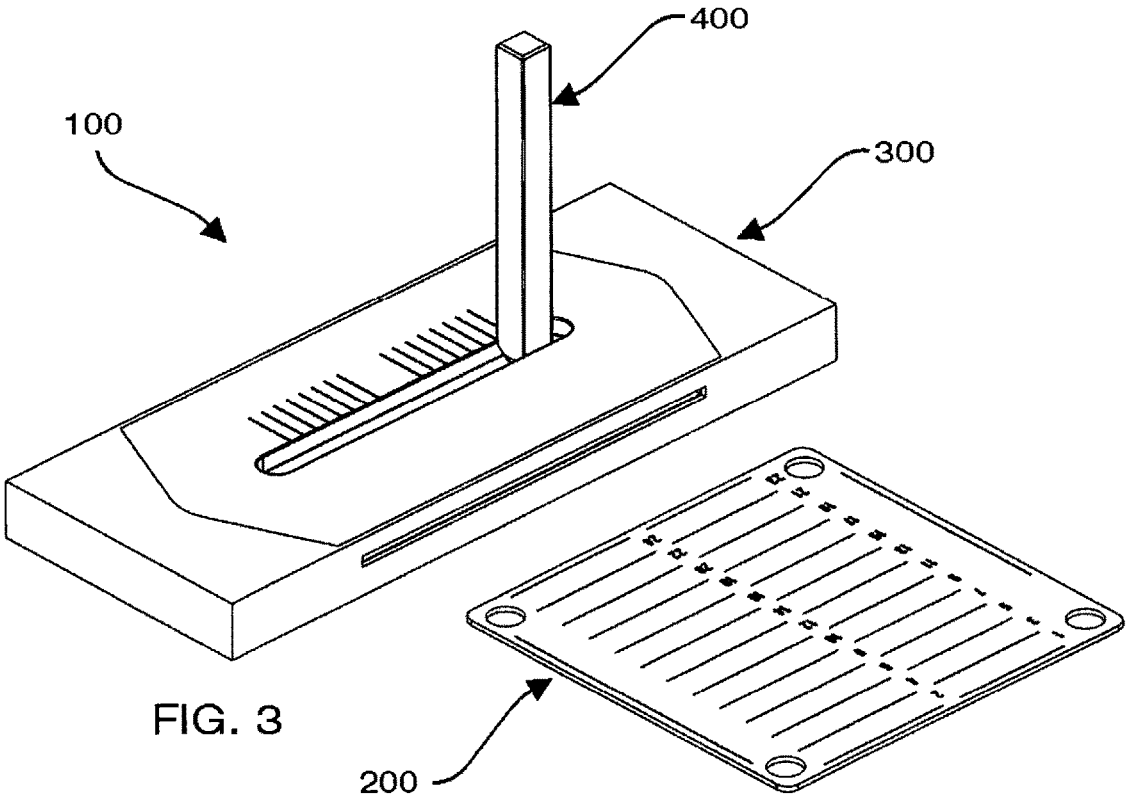
Figure 4:
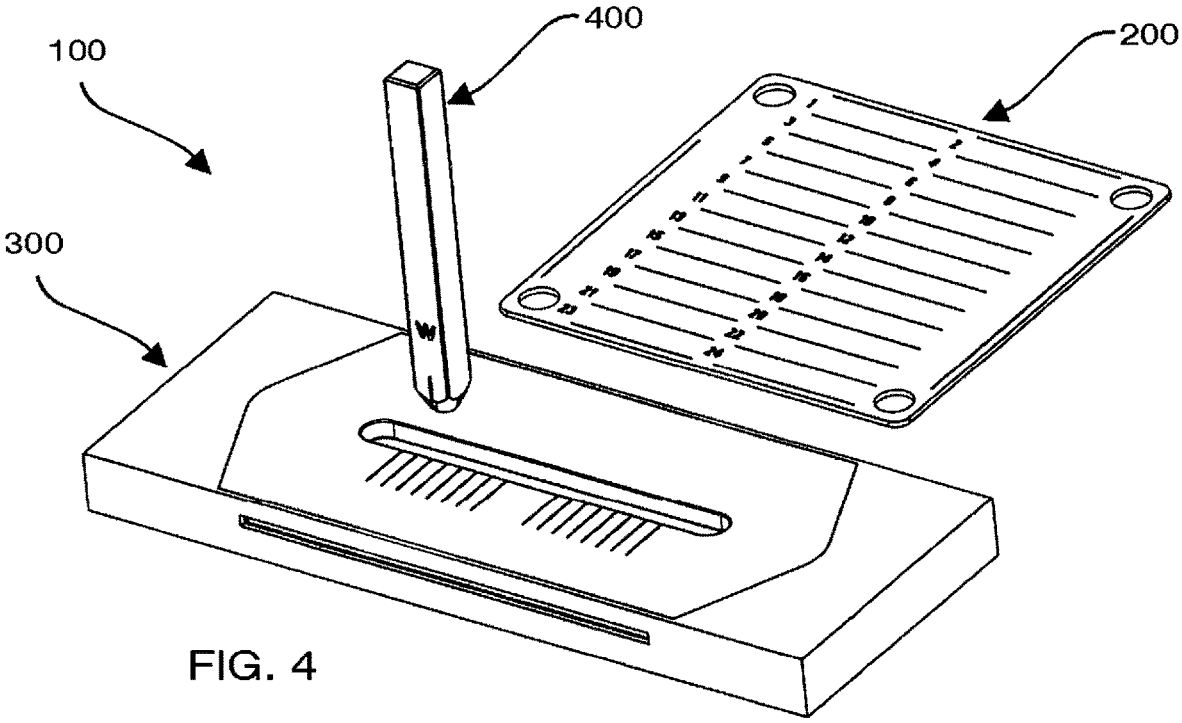

Embodiments of the presently disclosed stamping kit and components thereof are now described in detail with reference to the drawings, in which like reference numerals designate identical or corresponding elements in each of the several views. As used herein the term "distal" refers to that portion of the stamping kit, or component thereof, farther from a user, while the term "proximal" refers to that portion of the stamping kit, or component thereof, closer to the user.

Figure 5:
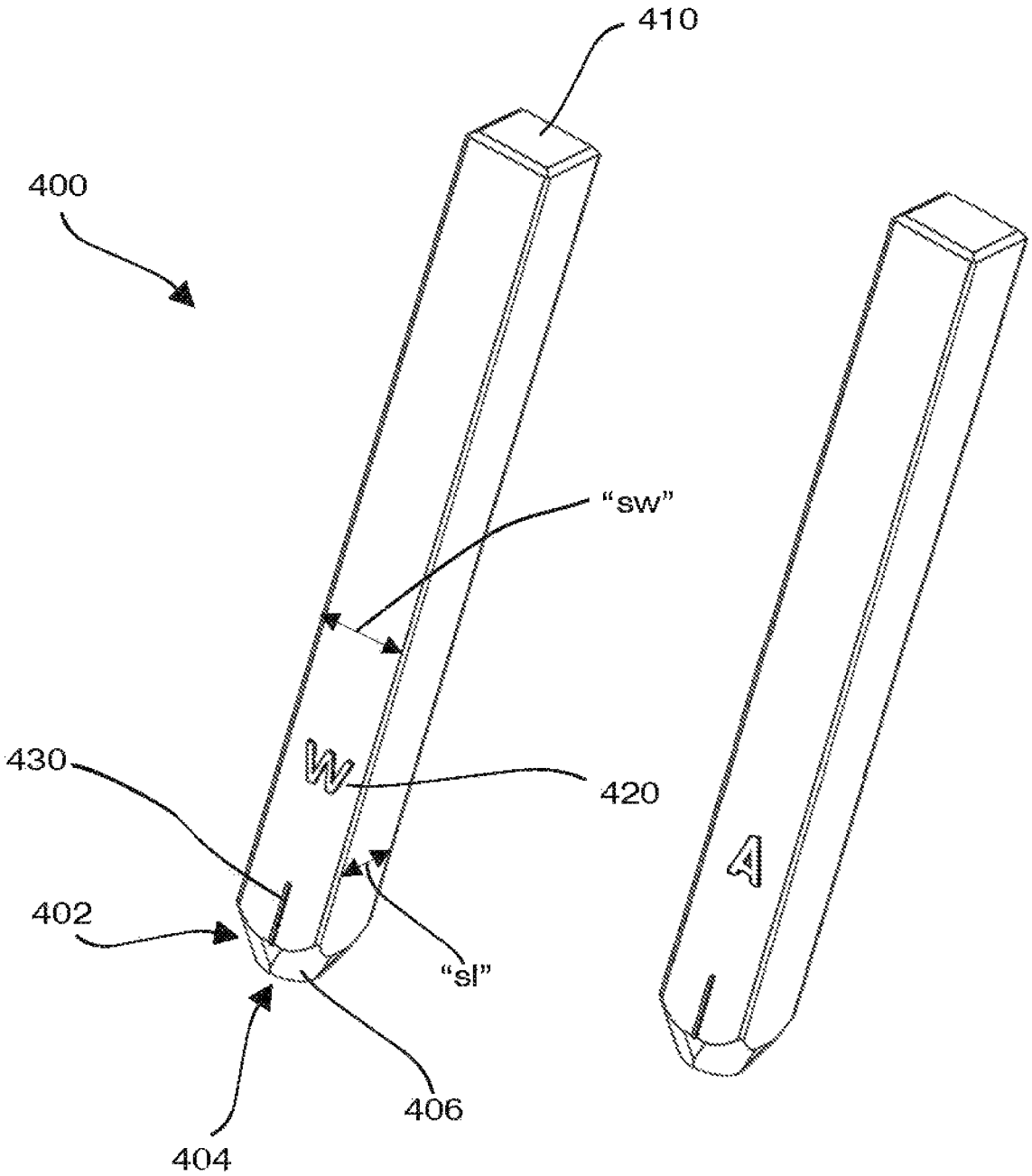
FIG. 5 is a perspective view of two representative stamps of a plurality of stamps of the stamping kit of FIGS. 1-4.
Figure 6:
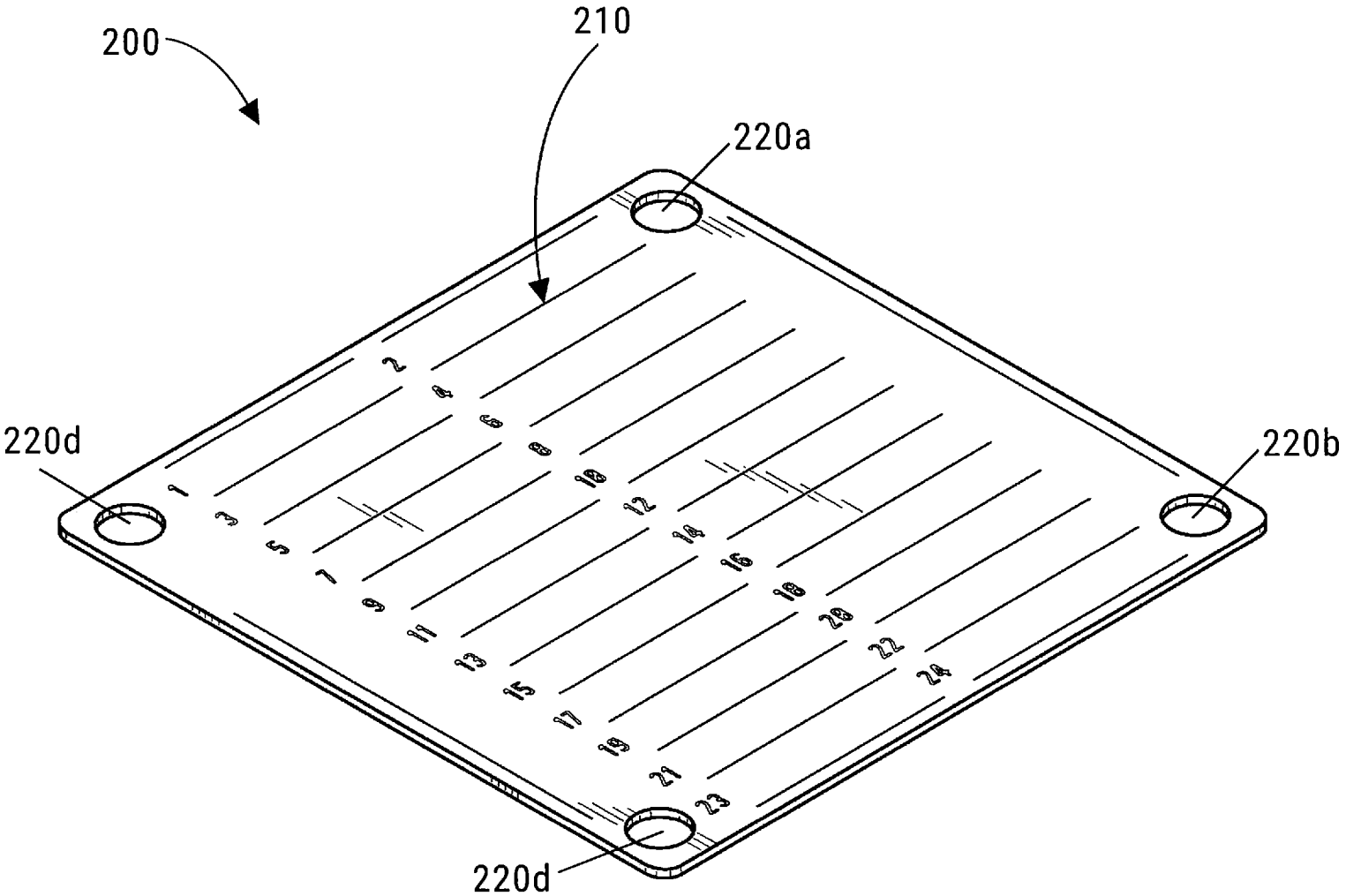
FIG. 6 is a perspective view of an embodiment of a card of the stamping kit of FIGS. 1-4.
Figure 7:
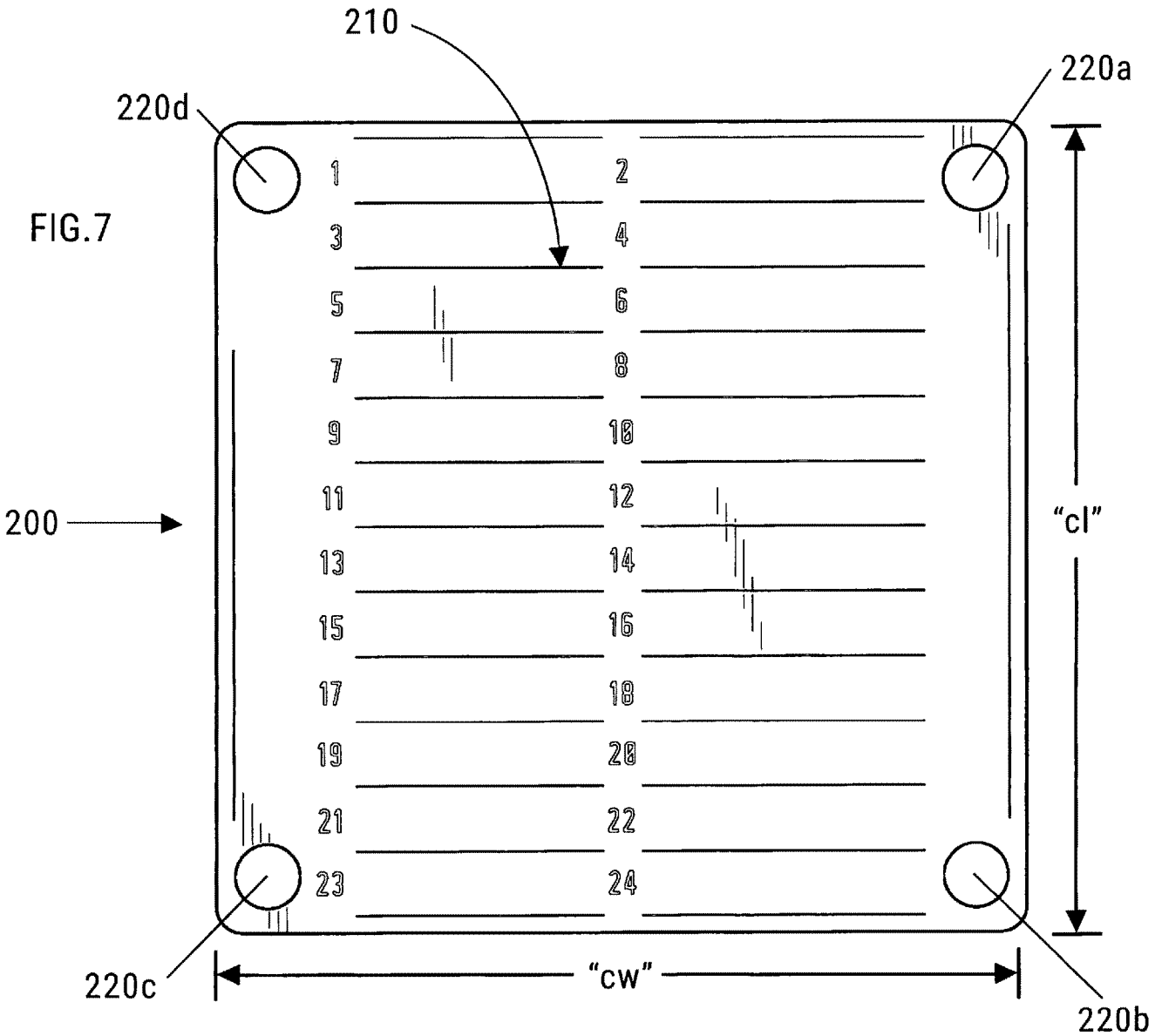
FIG. 7 is a top view of the card of FIG. 6.
Figure 8:
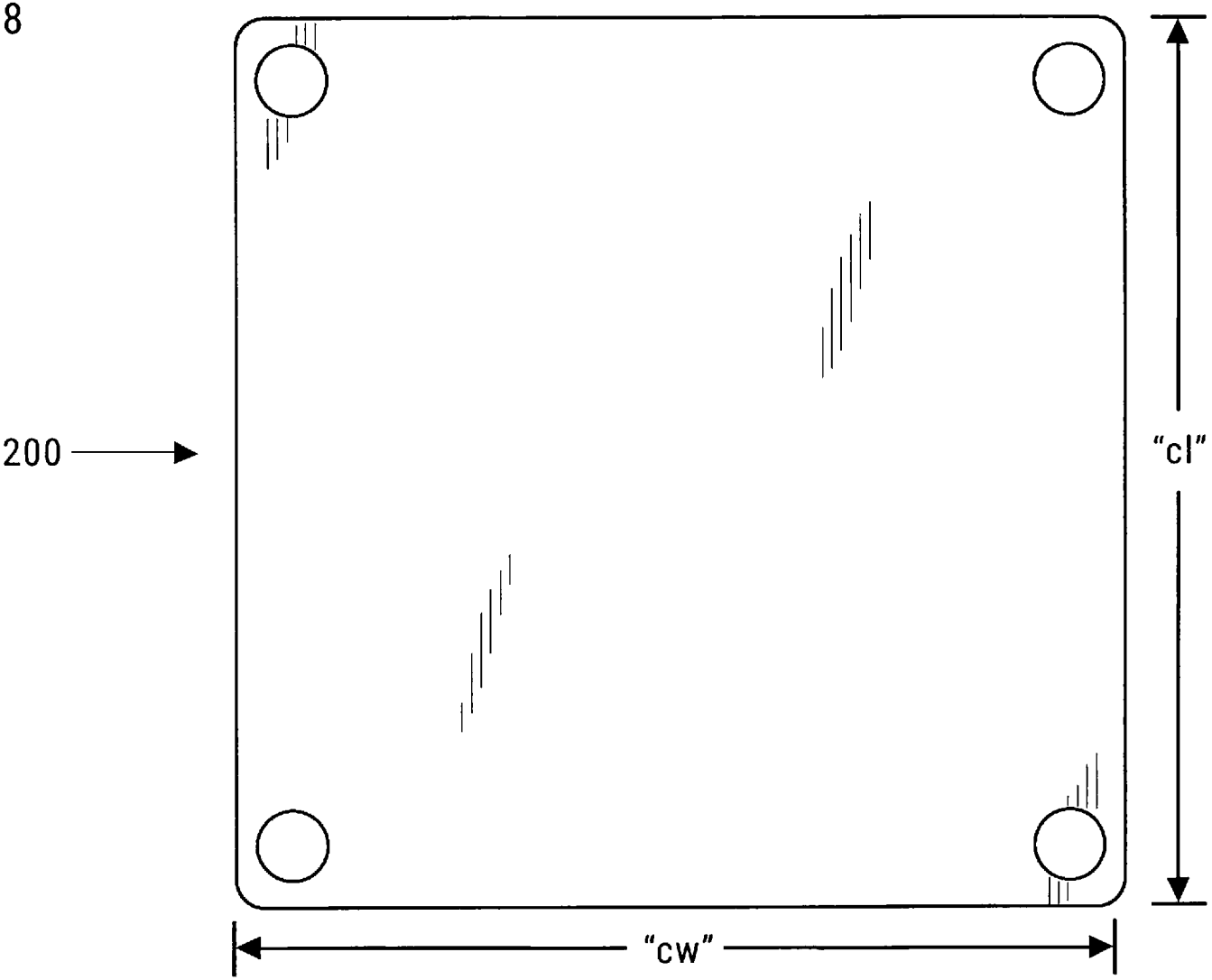
FIG. 8 is a bottom view of the card of FIG. 6.

An embodiment of a stamping kit is illustrated in the accompanying figures and is generally referenced by numeral 100. The stamping kit 100 includes any or all of the following: at least one card 200 (FIGS. 1-4 and 6-12); at least one jig 300 (FIGS. 1-4 and 13-19); a plurality of stamps 400 (FIGS. 1-5; two stamps are shown in FIG. 5; for clarity, a single stamp is referred to as "stamp 400"); and at least one first hammer 500*a* (FIGS. 20-26), second hammer 500*b* (FIGS. 27-33), and/or third hammer 500*c* (FIGS. 34-40). The first hammer 500*a*, the second hammer 500*b*, and third hammer 500*c* are collectively referred to as hammer 500, herein.

Generally, and with reference to FIGS. 1-4, a user utilizes the stamping kit 100 to stamp or imprint characters from the plurality of stamps 400 onto the card 200 with the aid of the jig 300 and/or the hammer 500 (FIGS. 20-40). More specifically, and as described in further detail below, a user can position the card 200 partially within the jig 300, use the jig 300 to help position the stamp 400 at a desired location on the card 200, and use the hammer 500 to hit the stamp 400 thereby imprinting a character on the stamp 400 onto the card 200.

With reference to FIG. 5, a representative stamp 400 of the plurality of stamps 400 is shown. The stamp 400 includes a distal portion 402 configured for insertion into a stamping slot 360 of the jig 300 (discussed in further detail below), and a proximal end 410 configured to be engaged with the hammer 500. The stamp 400 also includes a first indicia 420, which indicates which character is on a distal end 404 of the stamp 400. Additionally, as indicated below, the stamp 400 includes a stamp marker 430 at the distal portion 402 thereof. As shown, the stamp 400 includes a tapered portion 406 adjacent the distal end 404.

With particular regard to FIGS. 6-12, the card 200 is shown. The card defines a width "cw," a length "cl," and a thickness "ct," and is configured to have characters imprinted thereon. Additionally, in the illustrated embodiment, the card 200 includes 24 enumerated lines 210 thereon. While 24 enumerated lines 210 are illustrated, the carte 200 may include more or fewer than 24 enumerated lines without departing from the scope of the disclosure. The enumerated lines 210 are configured to help align and/or organize various words, symbols and/or phrases, such as seed words for cryptocurrency wallets. Some types of cryptocurrency utilize 12 seed words, and some types of cryptocurrency utilize 24 seed words. Thus, the illustrated card 200 can be useful to store the seed words for both of these types of cryptocurrency, in addition to cryptocurrency that may utilize fewer seed words. Further, the card 200 can be useful to store any type of words, including passwords or user IDs, and can also be configured to store more than 24 words without departing from the scope of the present disclosure. As used herein, the term "word" or "words" is intended to include any string of characters.

The card 200 in the illustrated embodiment defines a rectangle (inclusive of a square), and includes a card width "cw" of between about 6.35 cm (or about 2.5 inches) and about 8.89 cm (or about 3.5 inches) (e.g., equal to 7.62 cm or 3.0 inches), a length "cl" of between about 6.35 cm (or about 2.5 inches) and about 8.89 cm (or about 3.5 inches) (e.g., equal to 7.62 cm or 3.0 inches), and defines a card thickness "ct" of between about 1.5 mm (or about 0.06 inches) and about 2.5 mm (or about 0.1 inches) (e.g., equal to 2 mm or about 0.079 inches). In the illustrated embodiment, the card width "cw" is equal to the card length "cl." As discussed below, the dimensions of the card 200 enable the card 200 to fit within the jig 300 snugly.

In embodiments, at least a portion of (including an entirety of) the card 200 is made from titanium or a titanium alloy. Titanium is a suitable material for the card 200 because it is waterproof, non-corrosive (highly resistant to rusting and saltwater), fire resistant, and crush proof. Accordingly, cards 200 made from titanium are able to withstand various situations (including fires, floods, etc.) while still having the characters imprinted thereon being legible.

In embodiments, the entire card 200 is made from Grade 3 commercial titanium, is 2 mm thick, defines a length of 7.62 cm (3.0 inches), and defines a width of 7.62 cm (3.0 inches). The particular thickness of 2 mm, as disclosed herein, along with the card 200 being made from Grade 3 commercial titanium, has been found to reduce vibration of the card 200 during stamping, to enable the card 200 to remain flat while undergoing the forces associated with being stamped, and allows the stamp 400 to penetrate the card 200 an appropriate depth such that the characters imprinted that are imprinted on the card 200 are legible. More particularly, if the card 200 is too thin (and/or made from too weak a grade of titanium), the card 200 will curl or bend during the stamping process, which may result in the card 200 becoming stuck in the jig 300. If the card 200 is too thick (and/or made from too strong a grade of titanium), it is challenging to create the proper amount of force with the hammer 500 against the proximal end 410 of the stamp 400 to sufficiently imprint the character on the stamp 400 onto the card 200.

With continued reference the embodiment of the card 200 illustrated in FIGS. 6-12, the card 200 defines four apertures 220*a-d* (collectively, aperture 220), with each aperture 220 defined near a corner of the card 200. One or more of the apertures 220*a-d* (individually or in combination) may be useful to secure multiple cards 200 together with a locking mechanism, for instance.

Referring now to FIGS. 13-19, an embodiment of the jig 300 is shown. The jig 300 includes an upper surface 310, a lower surface 320, a front surface 330, a rear surface 340, a card slot 350, and a stamping slot 360. The card slot 350 extends between the front surface 330 and the rear surface 340 and is configured to accept the card 200 therethrough. The stamping slot 360 extends between the upper surface 310 and the card slot 350 and is configured to accept a portion of the stamp 400 therethrough. In the illustrated embodiment, the stamping slot 360 is perpendicular to the card slot 350. More particularly, the direction of a height "ssh" of the stamping slot 360 is perpendicular to the direction of a length "csl" of the card slot 350.

Moreover, the card slot 350 is dimensioned and configured such that the card 200 is able to snugly pass through. Further, the card slot 350 defines a width "csw" and a height "csh." In embodiments, the width "csw" of the card slot 350 is approximately equal to the width "cw" of the card 200 (e.g., about 3.0 inches), and the height "csh" of the card slot 350 is approximately equal to the thickness "ct" of the card (e.g., about 2 mm).

In the illustrated embodiment, the width "csw" of the card slot 350 is slightly larger than the width "cw" of the card 200, and the height "csh" of the card slot 350 is slightly larger than the thickness "ct" of the card 200 to allow the card 200 to be passed through the card slot 350 with minimal play. In embodiments, the width "csw" of the card slot 350 and the height "csh" of the card slot are between about 0.25% and about 2% larger than the respective dimensions of the card 200 to help ensure a sufficient fit. Moreover, in embodiments, the width "csw" of the card slot 350 is equal to about 3.016 inches, and the height "csh" of the card slot 350 is equal to about 0.08 inches. As used herein, the term "approximately equal" and "about" (or similar) is intended to encompass such a difference in sizes.

The stamping slot 360 of the jig 300 is dimensioned and configured to accept a portion of the stamp 200 therein and to align the stamp 200 for imprinting its character onto the card 200. Further, the stamping slot 360 defines a length "ssl," a width "ssw," and a height "ssh." In embodiments, the length "ssl" of the stamping slot 360 is between about 0.20 inches and about 0.30 inches (e.g., equal to about 0.254 inches), and the width "ssw" of the stamping slot 360 is between about 2.5 inches and about 2.75 inches (e.g., equal to about 2.688 inches). In embodiments, the height "ssh" of the stamping slot 360 is between about 0.175 inches and about 0.235 inches (e.g., equal to about 0.21 inches).

In the illustrated embodiment, the length "ssl" of the stamping slot 360 is slightly larger than a length "sl" of the distal portion 402 of the stamp 400 (FIG. 5) to allow the distal portion 402 of the stamp 400 to be positioned within the stamping slot 360 with minimal play, as discussed in further detail below. The width "ssw" of the stamping slot 360 is sufficient such that two, side-by-side enumerated lines 210 of the card are visible through the stamping slot 360 when the card 200 is appropriately positioned within the card slot 350 of the jig 300.

With continued reference to FIGS. 13-19, the jig 300 includes a plurality of alignment marks 370 adjacent the stamping slot 360. Moreover, the alignment marks 370 may be in contact with a wall defining the stamping slot 360. The alignment marks 370 are configured to help achieve desired alignment and spacing of adjacent characters of words, for instance, by acting as a guide for a user to position the stamp marker 430 of the stamp 400 (FIG. 5) there along or in juxtaposition therewith (and see FIGS. 1 and 2). In the illustrated embodiment, the jig 300 includes 16 alignment marks 370, positioned in two sets of eight alignment marks 370. Each set of eight alignment marks 370 is configured to align with one enumerated line 210 of the card 200, as shown in FIG. 1.

Figure 18:
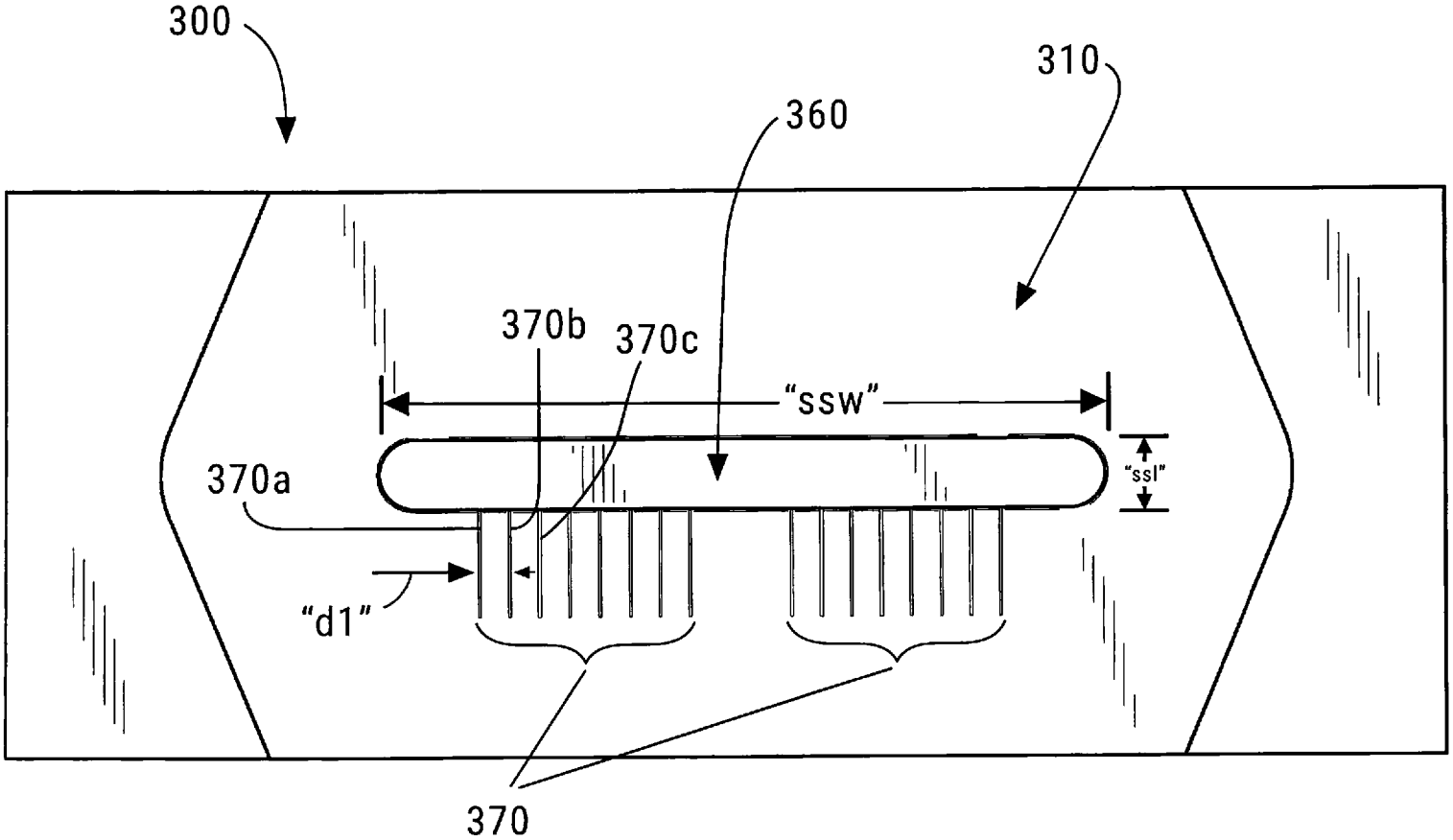
FIG. 18 is a top view of the jig of FIG. 13.
Figure 19:
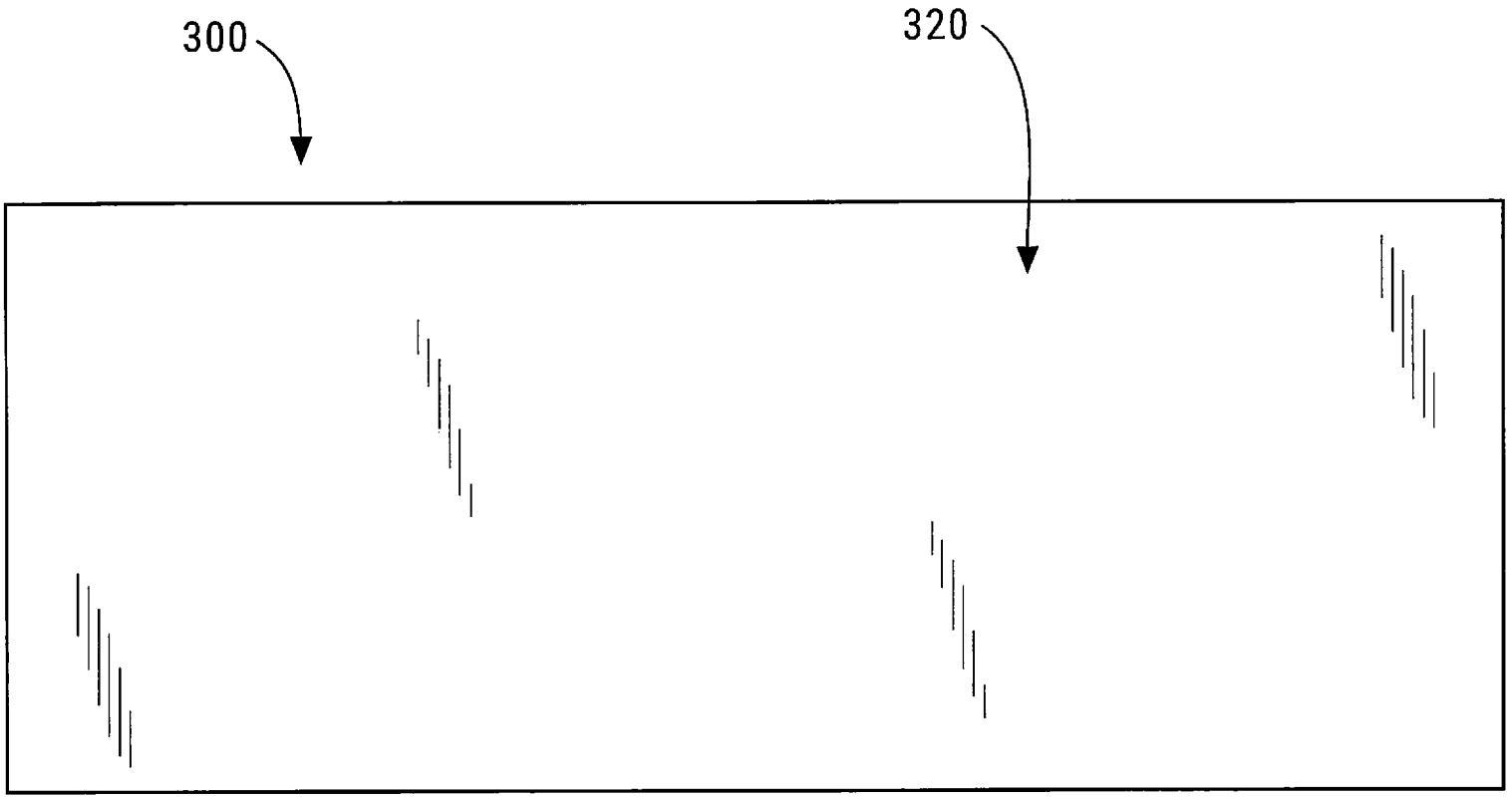
FIG. 19 is a bottom view of the jig of FIG. 13.
Figure 20:
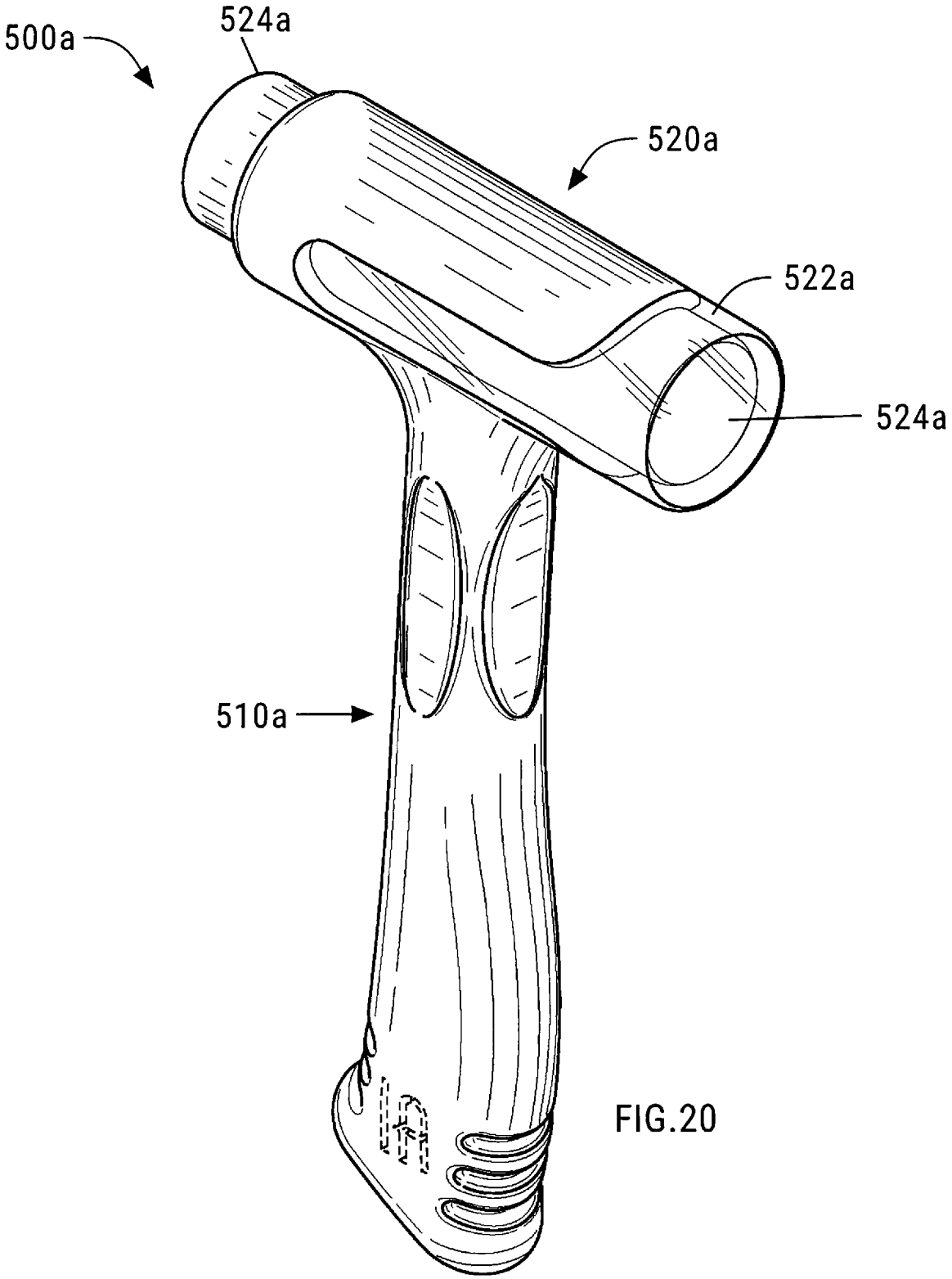
FIG. 20 is a left, front, perspective view of a first hammer of the stamping kit of FIGS. 1-4.
Figure 21:
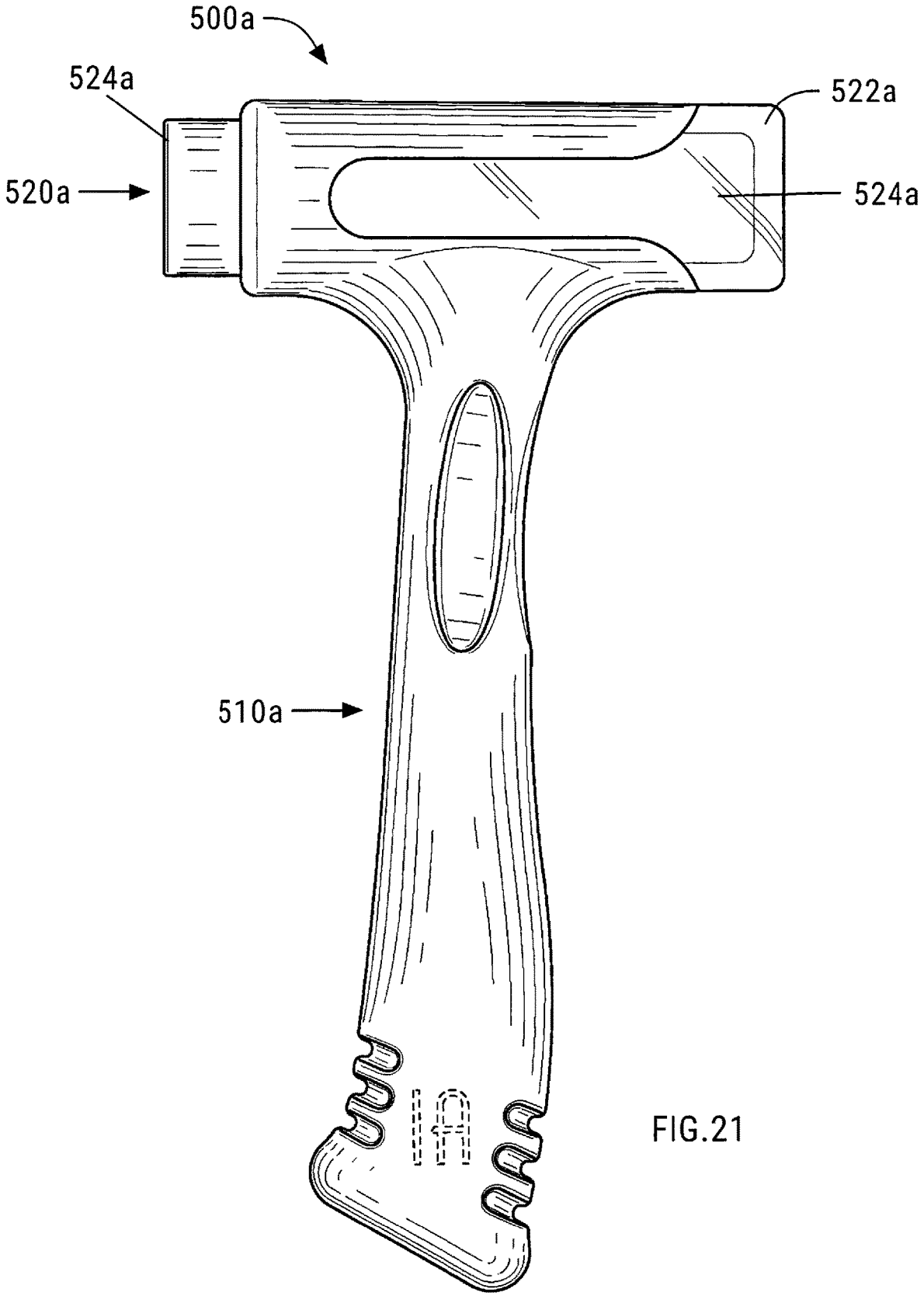
FIG. 21 is a left side view of the first hammer of FIG. 20.
Figure 22:
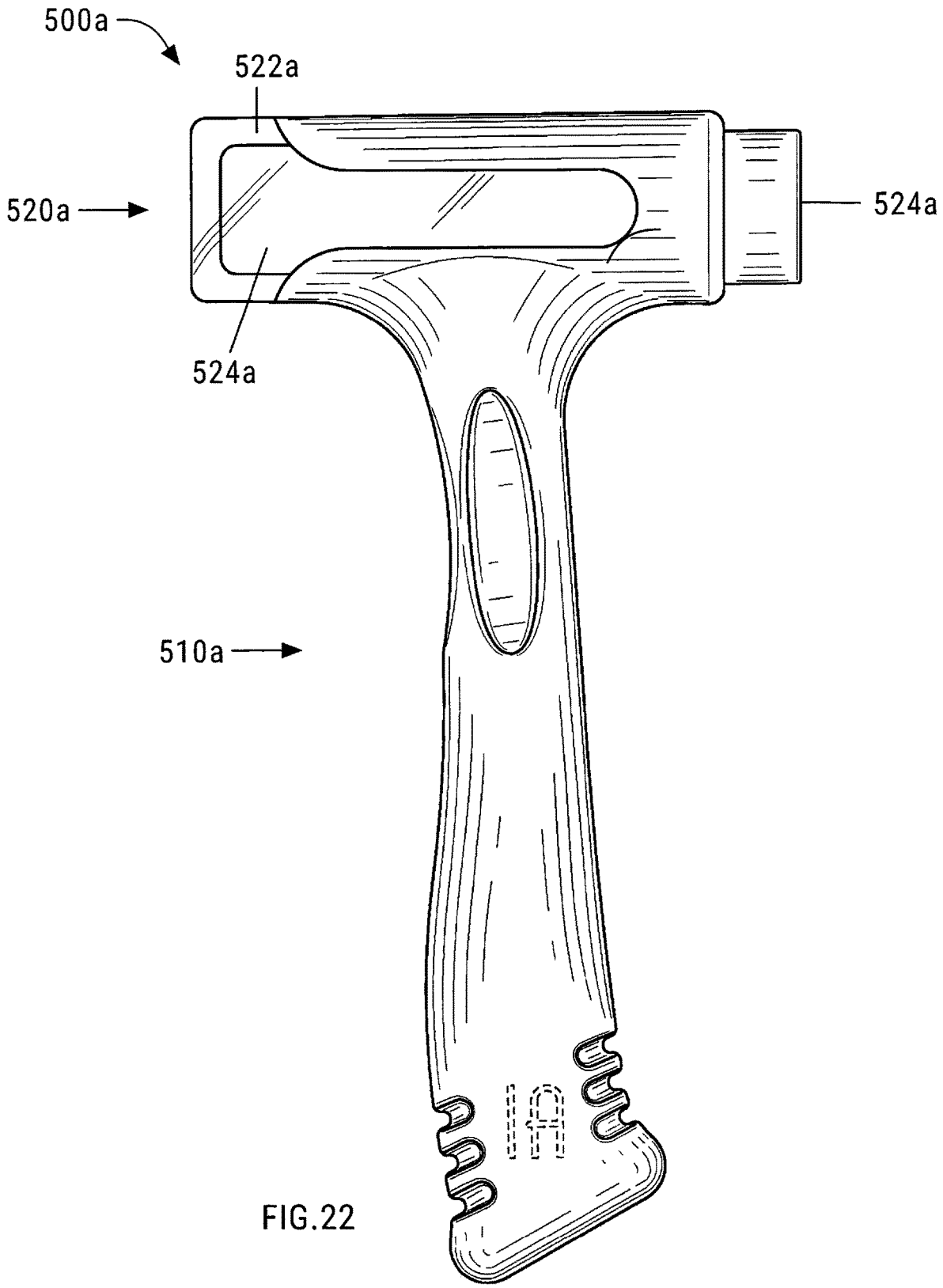
FIG. 22 is a right side view of the first hammer of FIG. 20.
Figure 23:
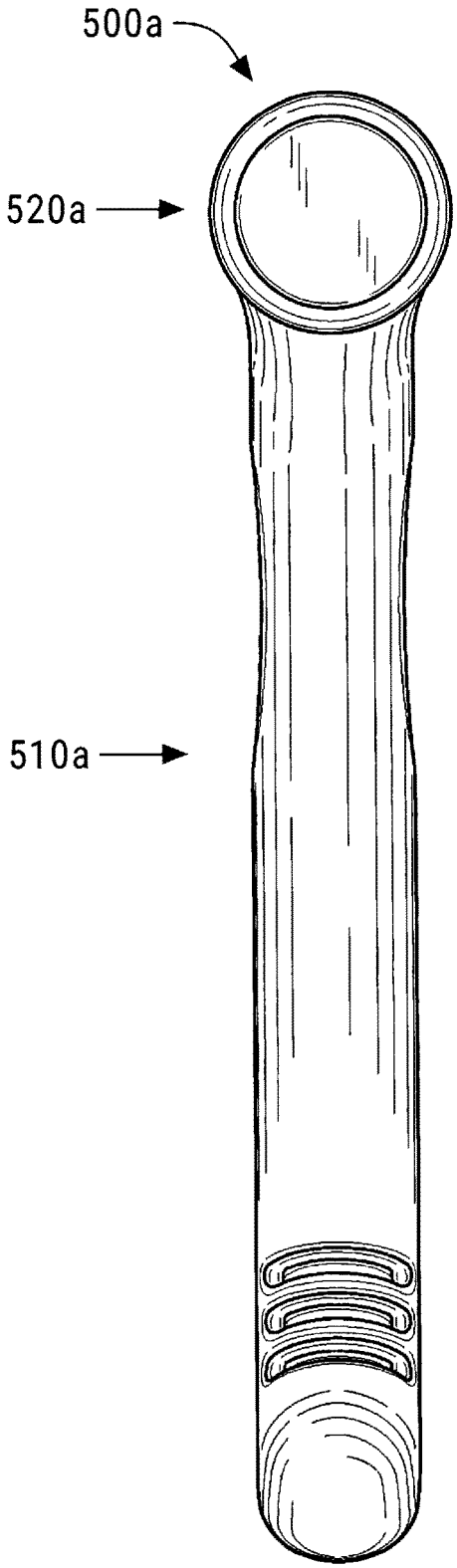
FIG. 23 is a rear view of the first hammer of FIG. 20.
Figure 24:
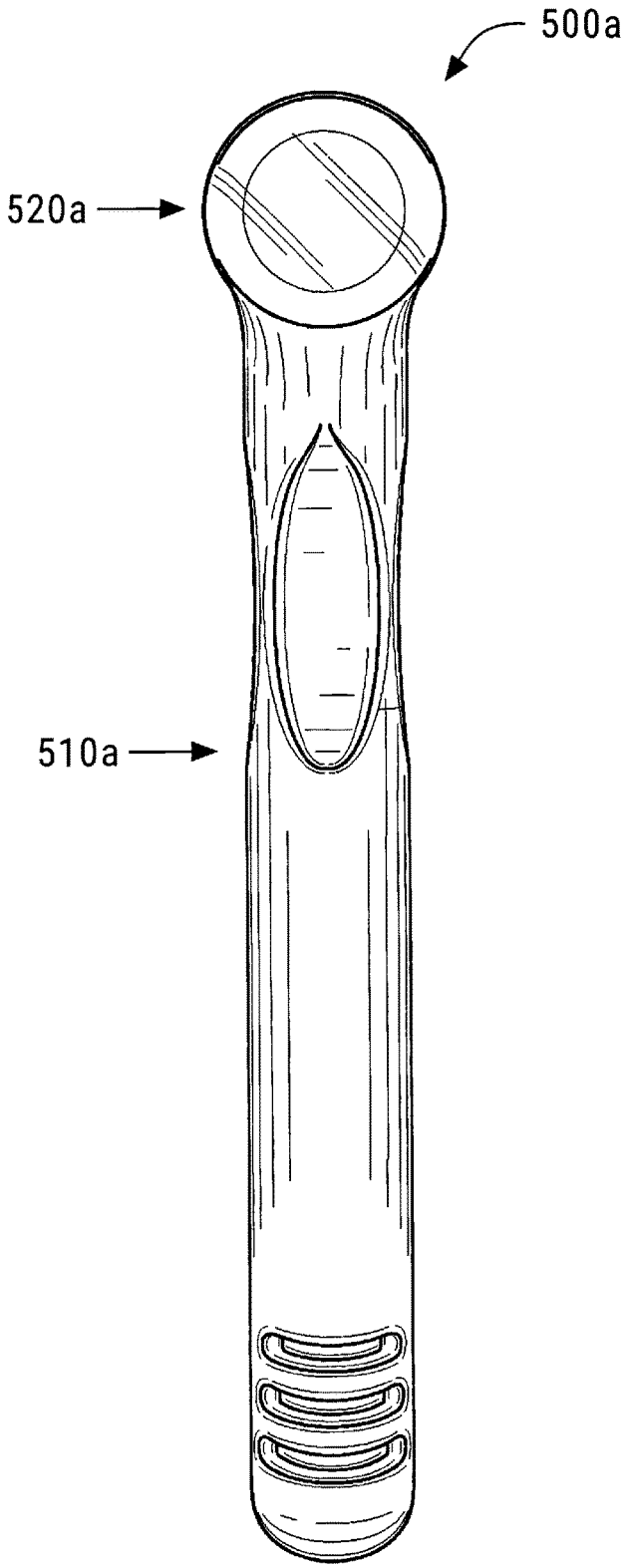
FIG. 24 is a front view of the first hammer of FIG. 20.
Figure 25:
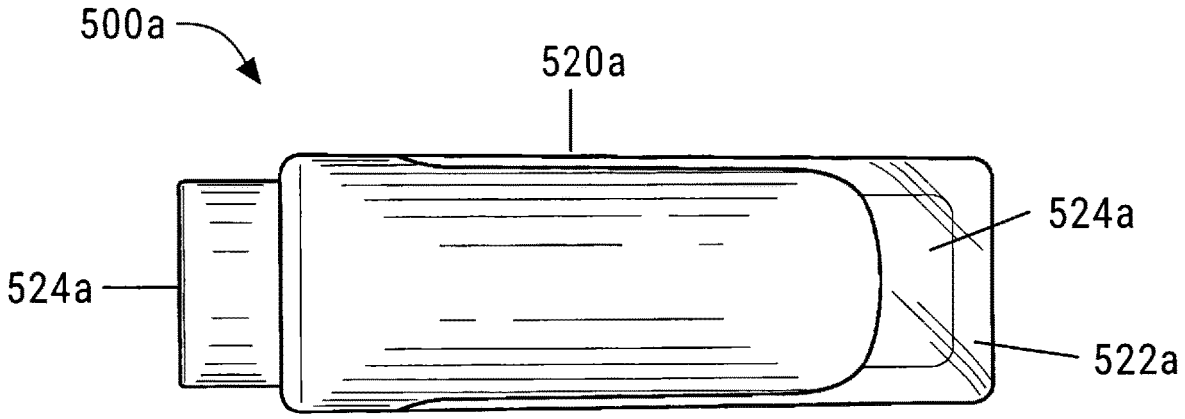
FIG. 25 is a top view of the first hammer of FIG. 20.
Figure 26:
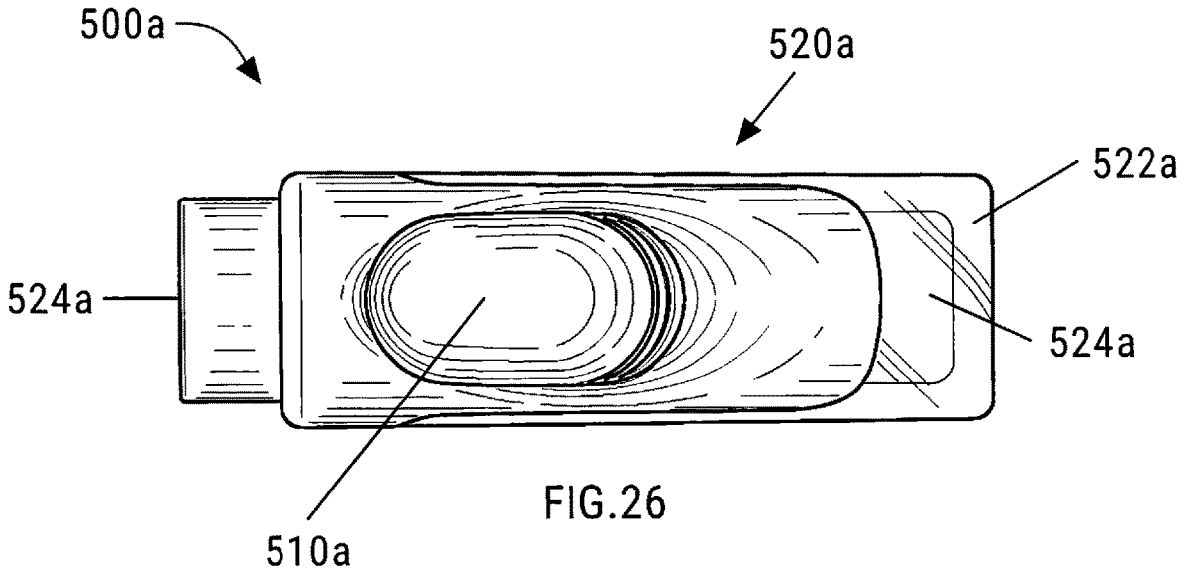
FIG. 26 is a bottom view of the first hammer of FIG. 20.
Figure 27:
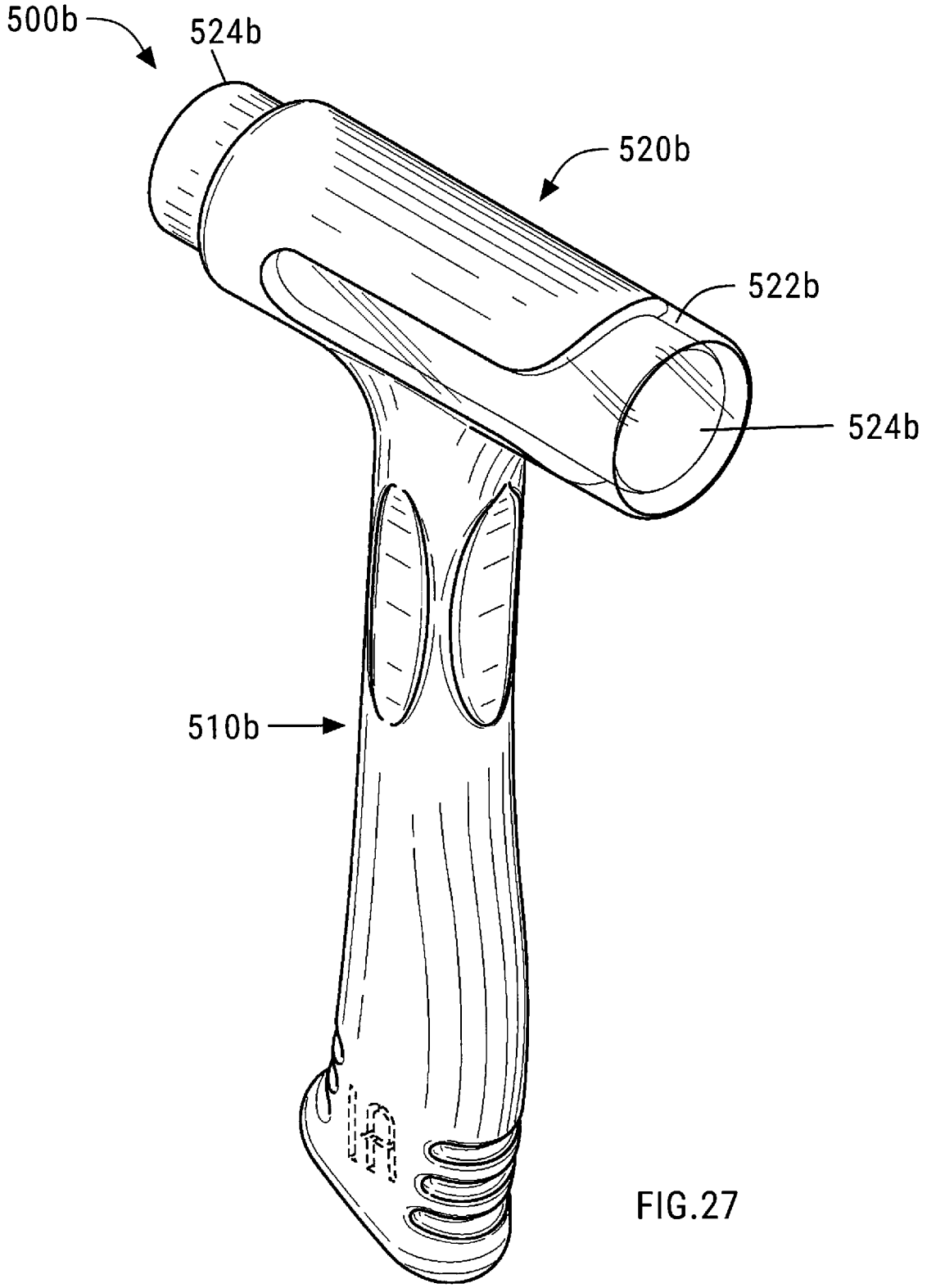
FIG. 27 is a left, front, perspective view of a second hammer of the stamping kit of FIGS. 1-4.
Figure 28:
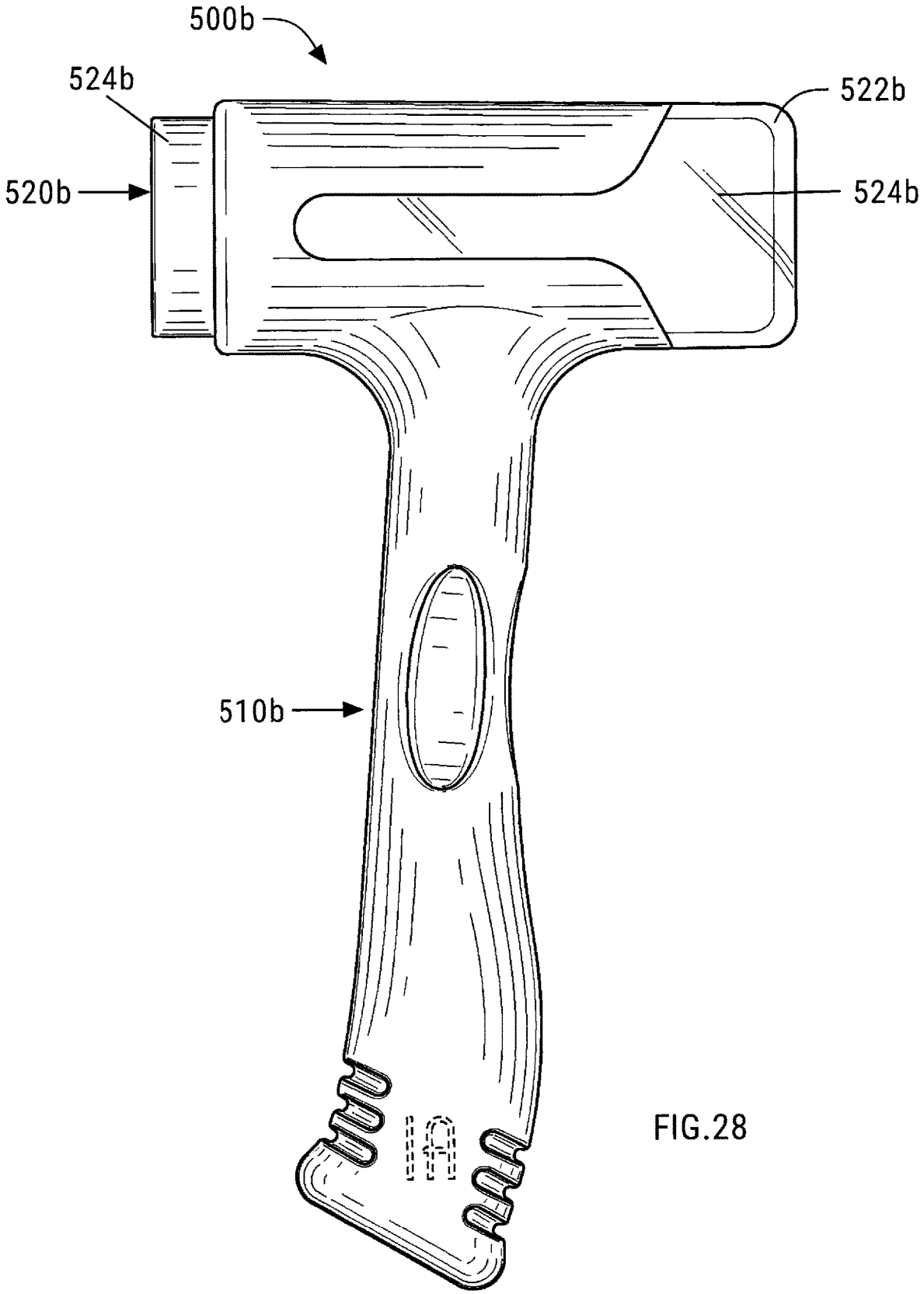
FIG. 28 is a left side view of the second hammer of FIG. 27.
Figure 29:
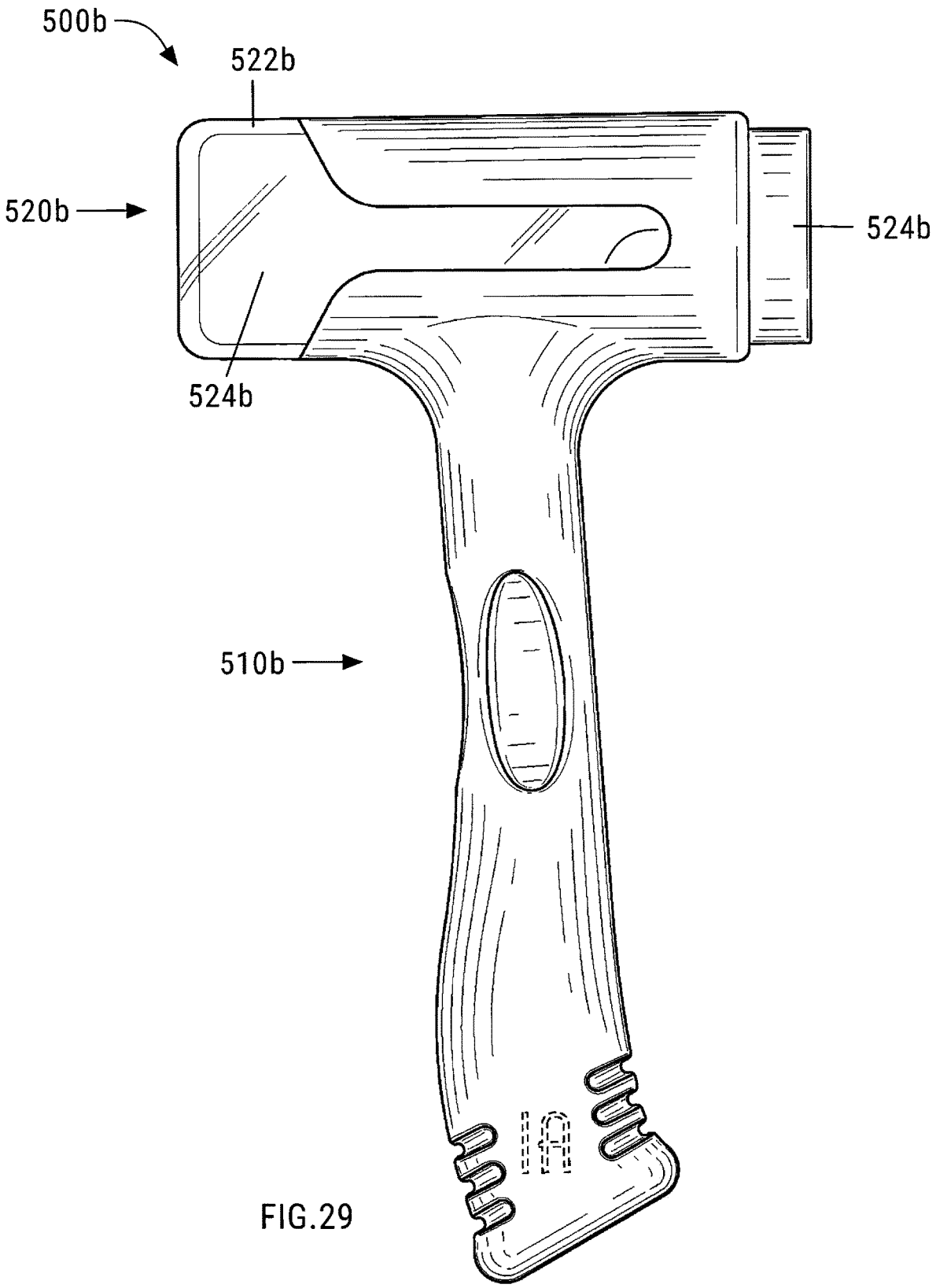
FIG. 29 is a right side view of the second hammer of FIG. 27.
Figure 30:
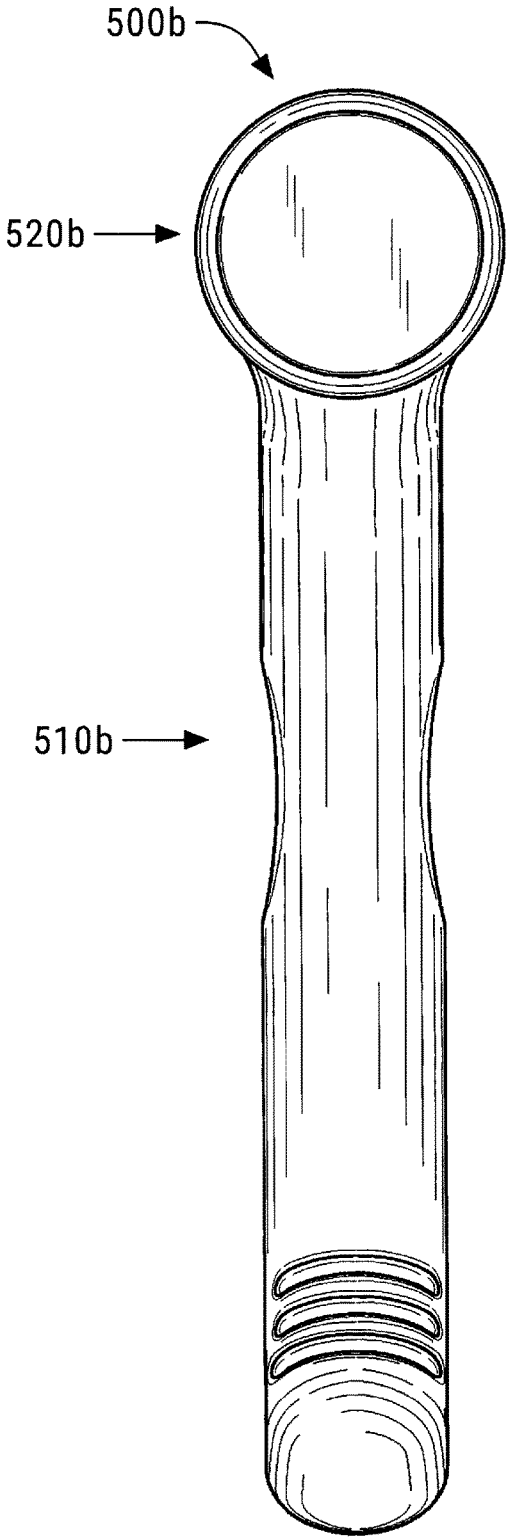
FIG. 30 is a rear view of the second hammer of FIG. 27.
Figure 31:
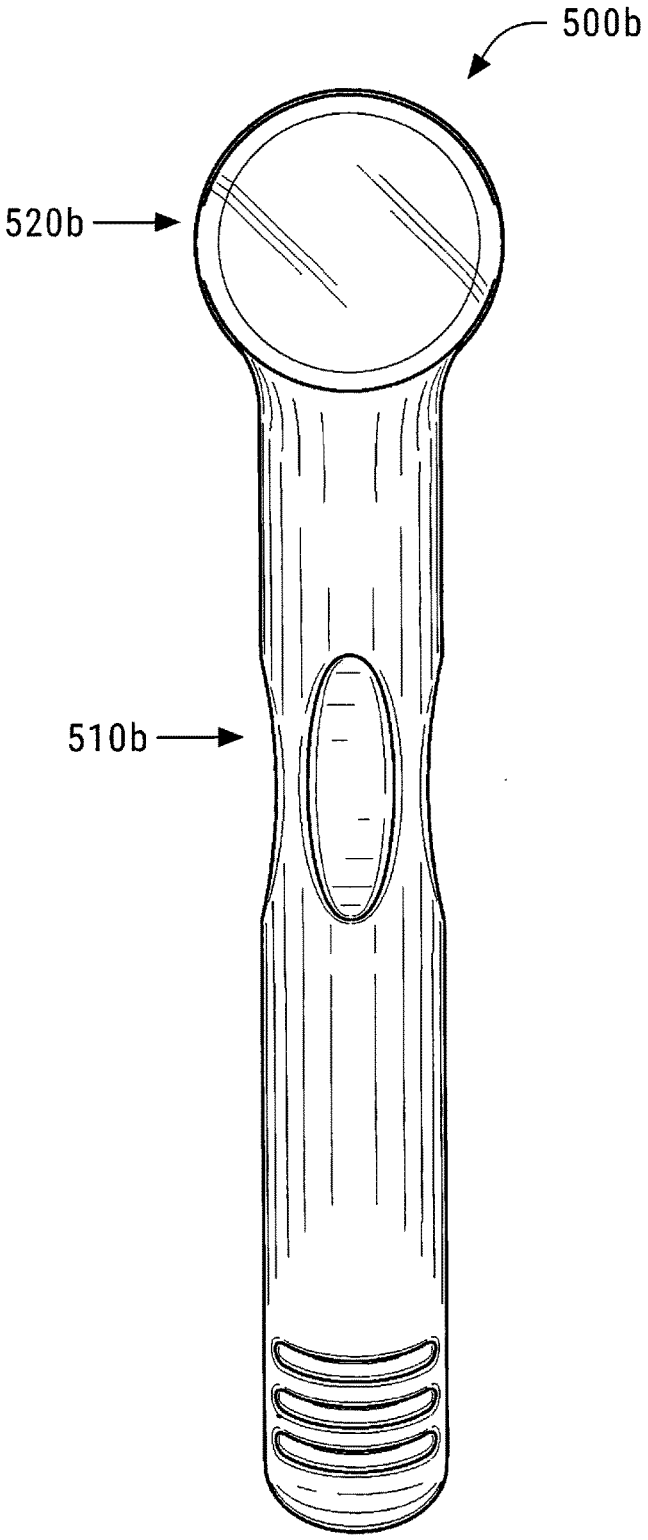
FIG. 31 is a front view of the second hammer of FIG. 27.
Figure 32:
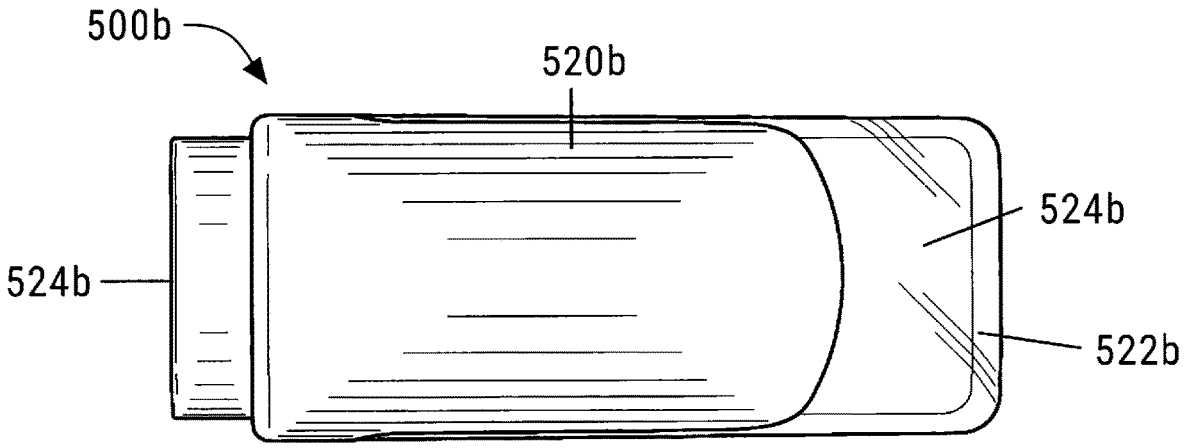
FIG. 32 is a top view of the second hammer of FIG. 27.
Figure 33:
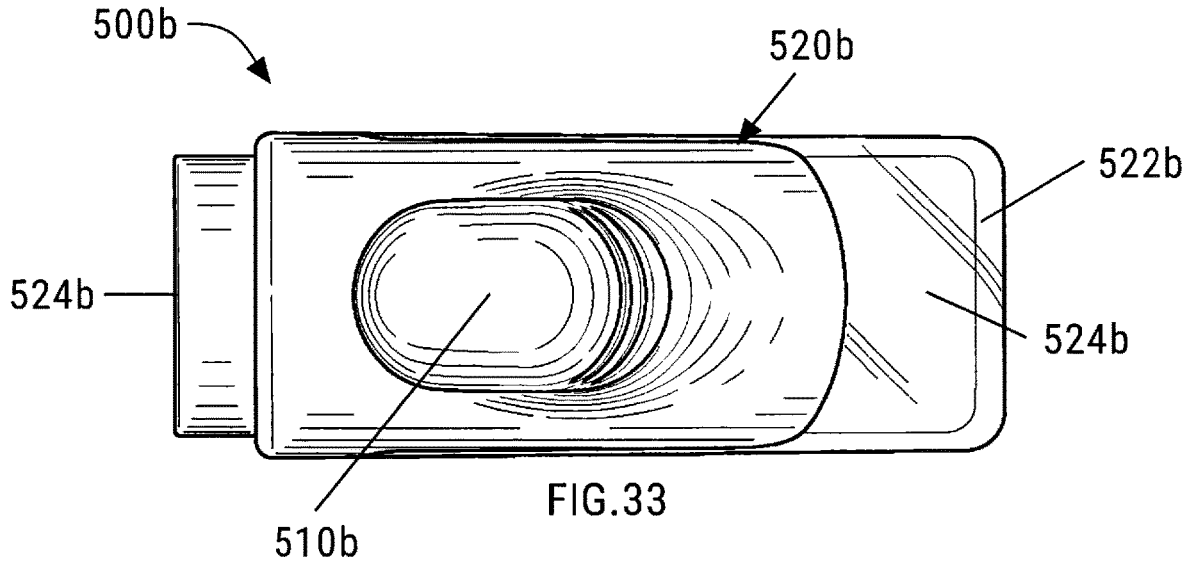
FIG. 33 is a bottom view of the second hammer of FIG. 27.
Figure 34:
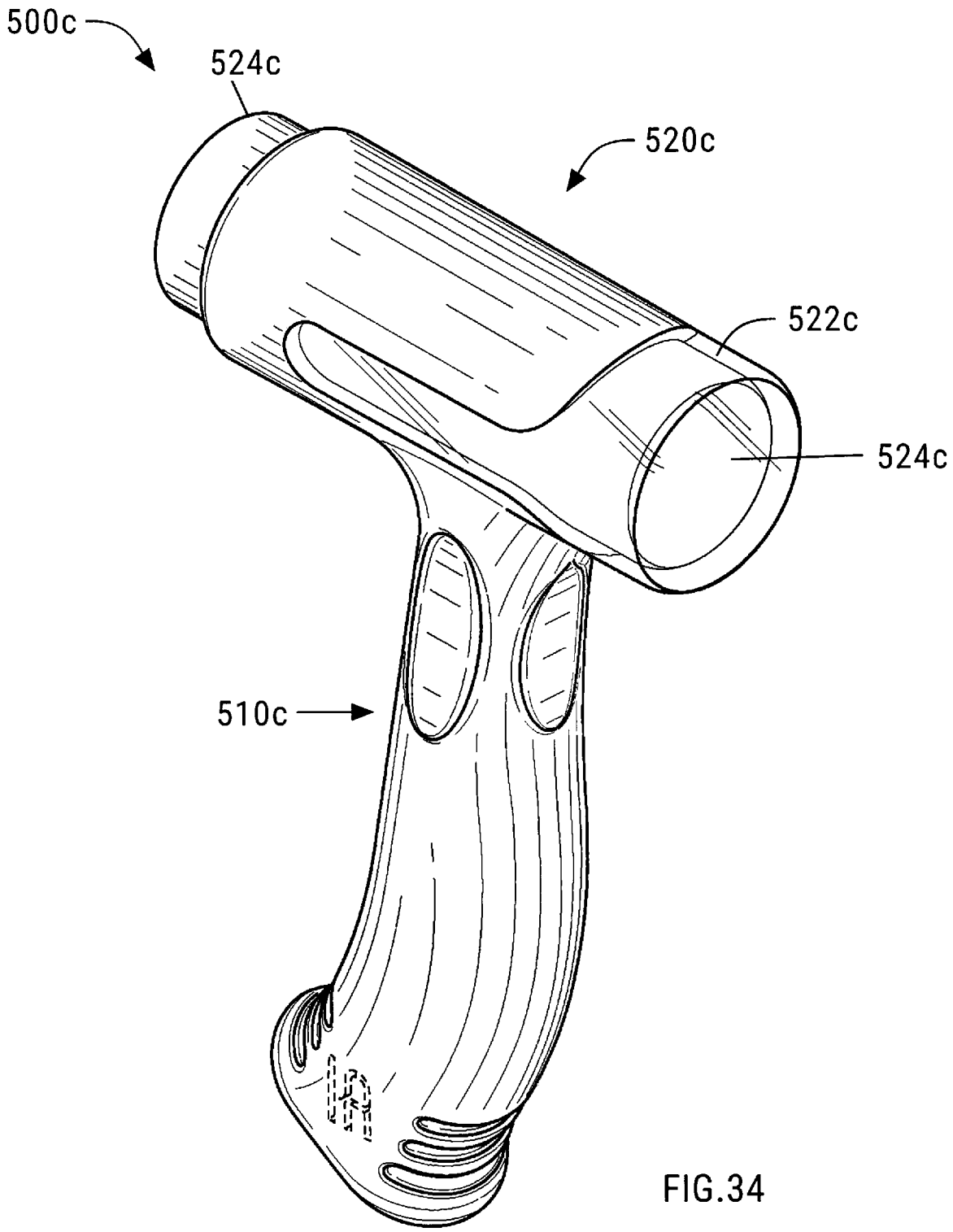
FIG. 34 is a left, front, perspective view of a third hammer of the stamping kit of FIGS. 1-4.
Figure 35:
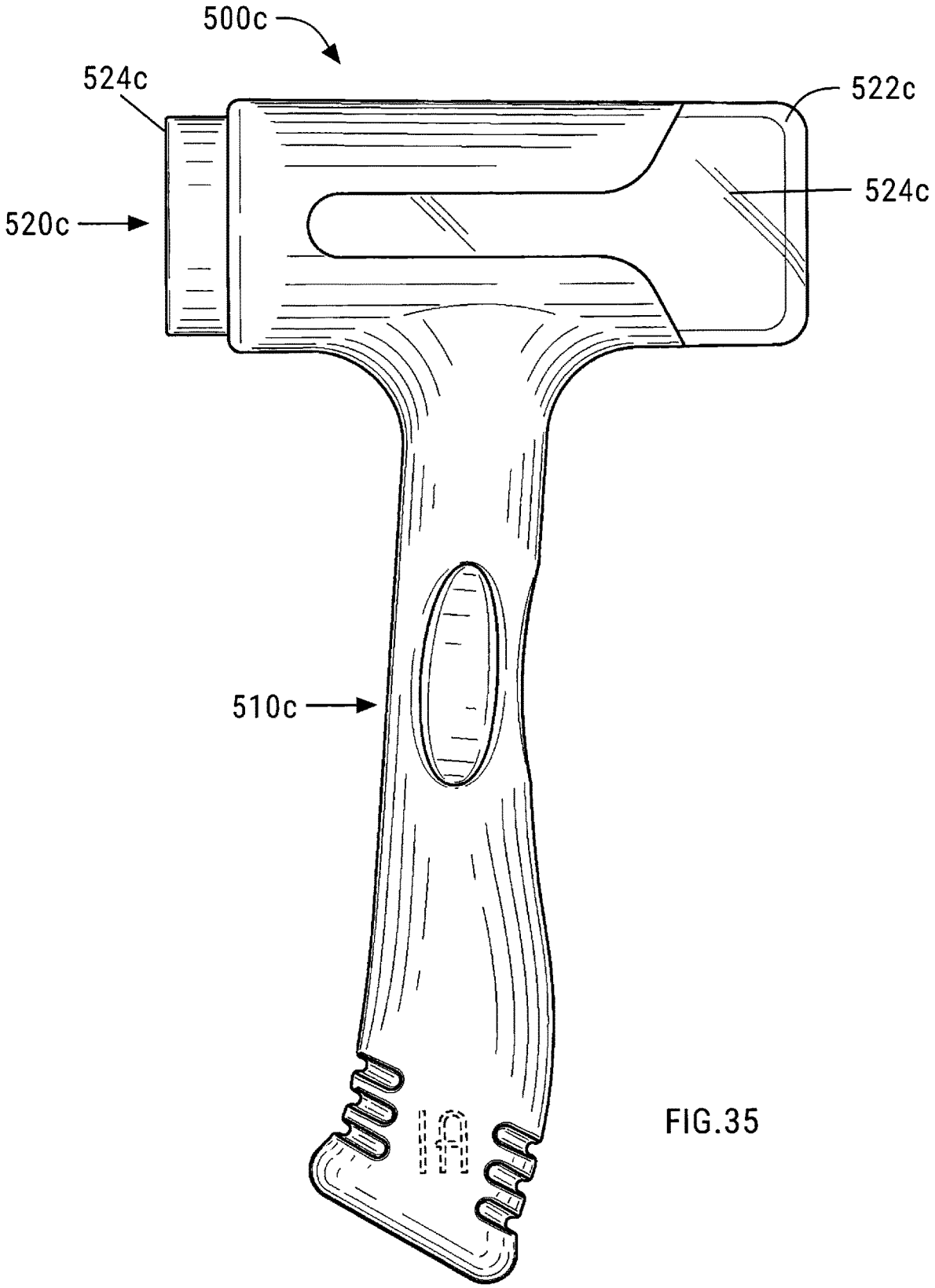
FIG. 35 is a left side view of the third hammer of FIG. 34.
Figure 36:
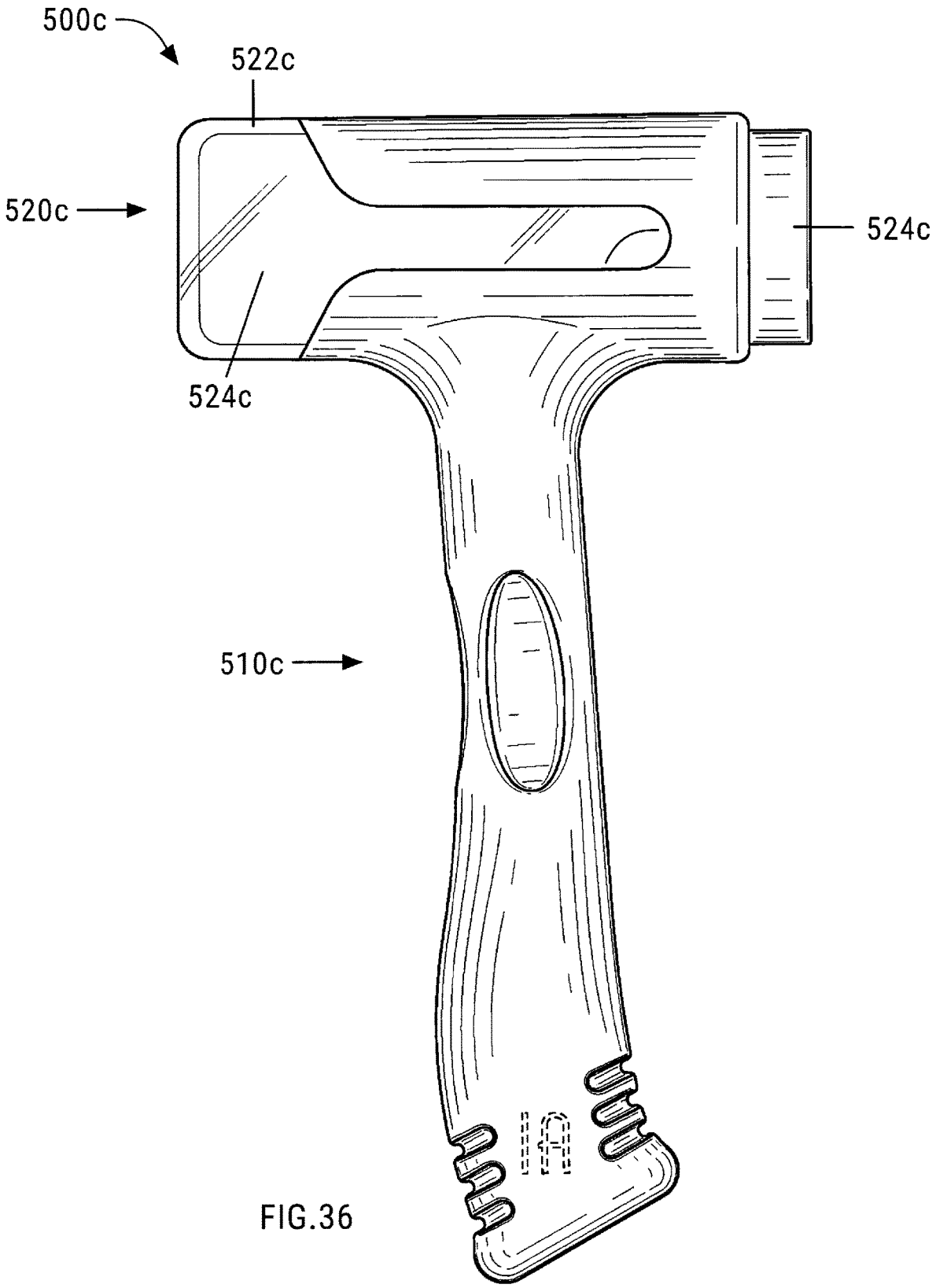
FIG. 36 is a right side view of the third hammer of FIG. 34.
Figure 37:
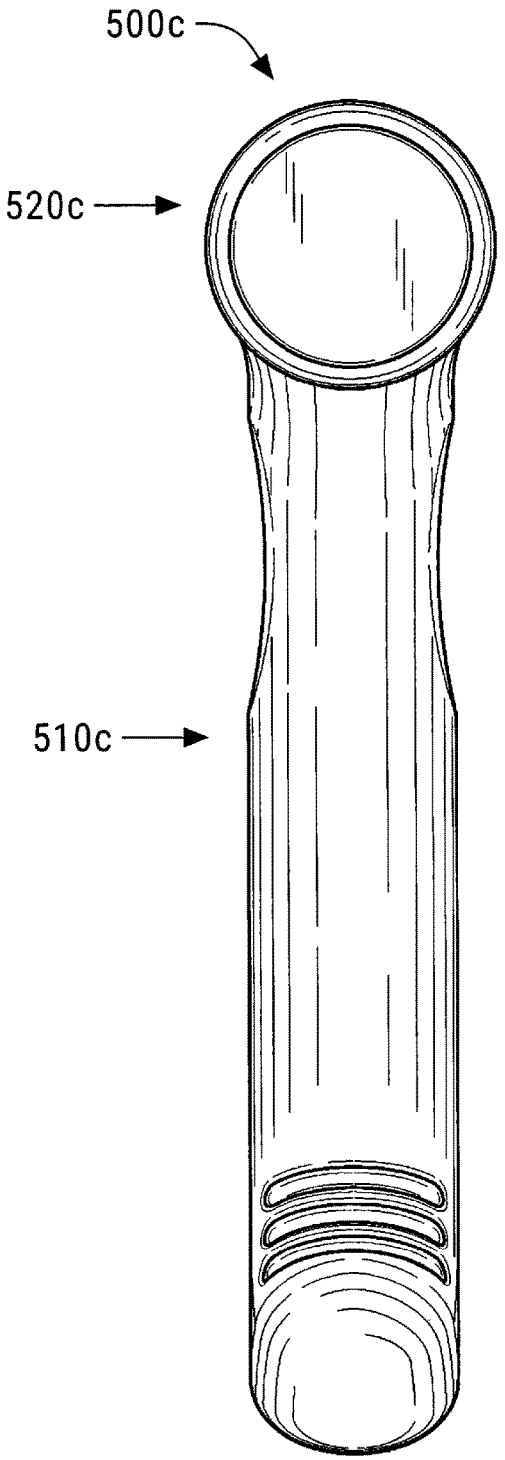
FIG. 37 is a rear view of the third hammer of FIG. 34.
Figure 38:
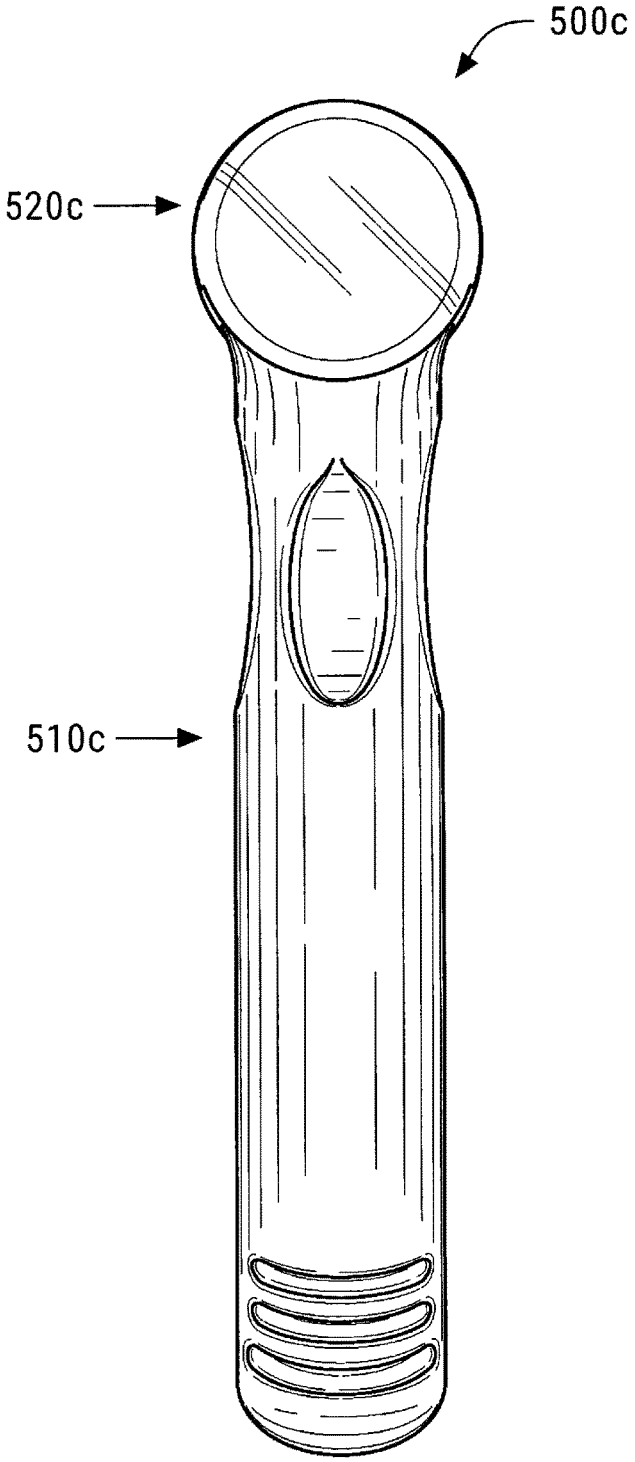
FIG. 38 is a front view of the third hammer of FIG. 34.
Figure 39:
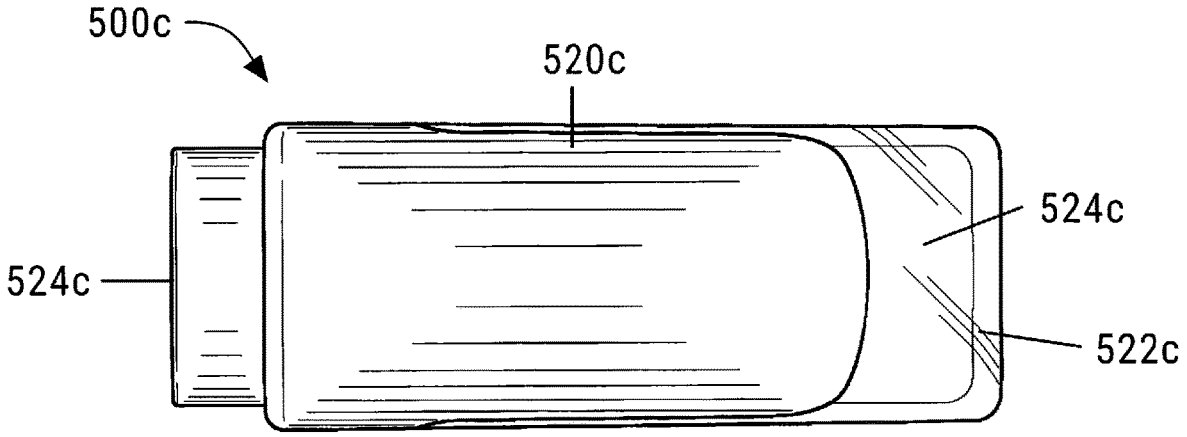
FIG. 39 is a top view of the third hammer of FIG. 34.
Figure 40:
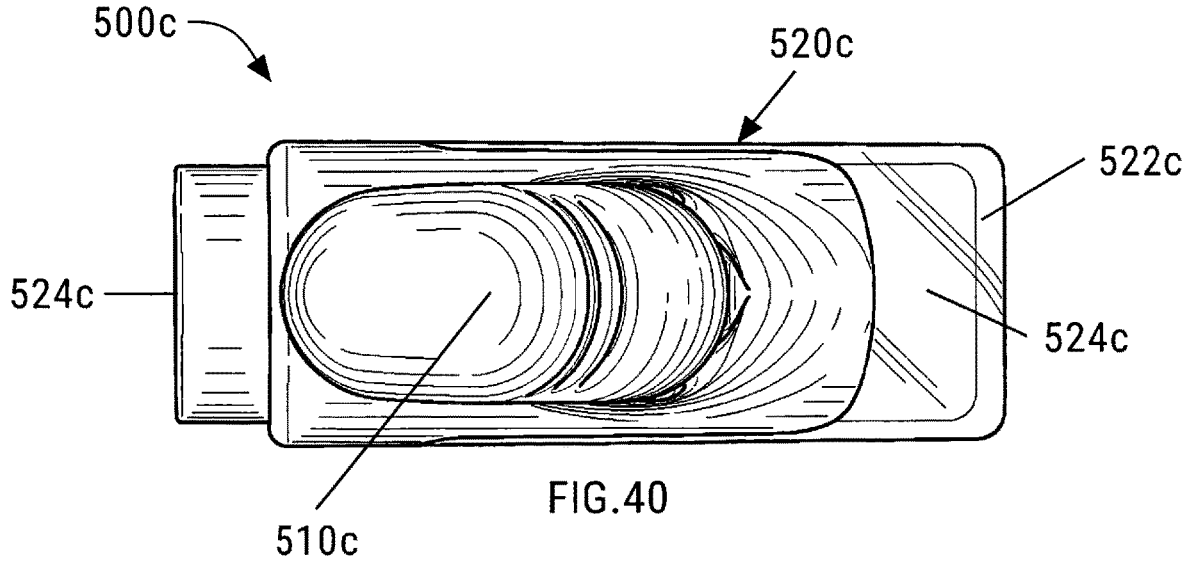
FIG. 40 is a bottom view of the third hammer of FIG. 34.

Additionally, the illustrated embodiment shows a particular spacing of the alignment marks 370 of the jig 300. In each set of alignment marks 370, adjacent alignment marks 370 are spaced a first distance "d1" apart from each other (FIG. 18). In embodiments, the first distance "d1" is equal to or approximately equal to half of a width "sw" of the stamp 200. That is, the width "sw" of the stamp 200 is equal to or approximately equal to the distance between a first alignment mark 370*a* and a third alignment mark 370*c*, for instance (FIG. 18). In embodiments, the first distance "d1" is between about 0.075 inches and about 0.135 inches (e.g., equal to about 0.11 inches). This spacing of adjacent alignment marks 370 (and thereby the spacing of characters on the card 200) help ensure that a certain maximum number of characters (e.g., eight characters) are able to legibly fit on each enumerated line 210 of the card 200.

Figure 13:
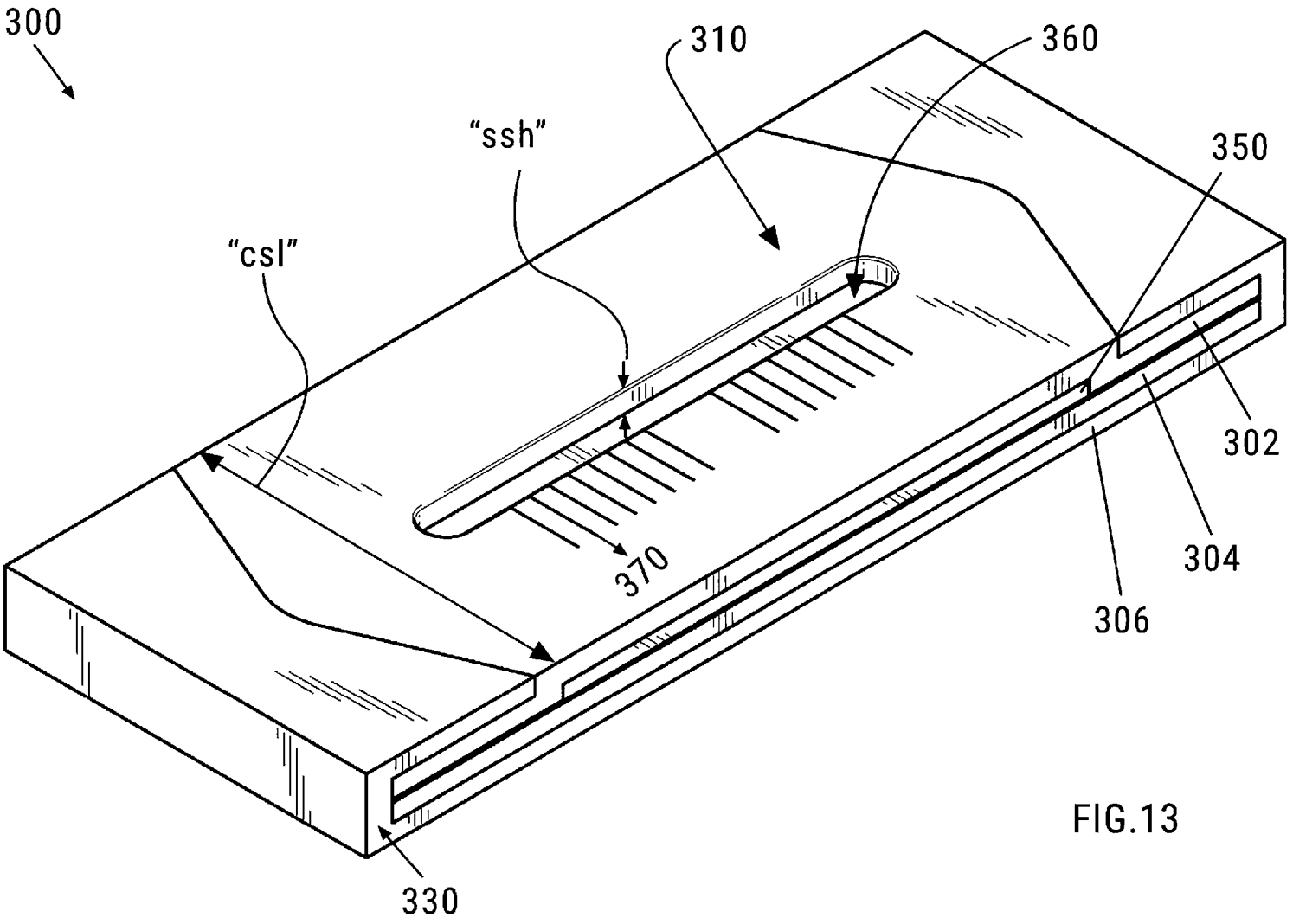
FIG. 13 is a perspective view of an embodiment of a jig of the stamping kit of FIGS. 1-4.
Figure 14:
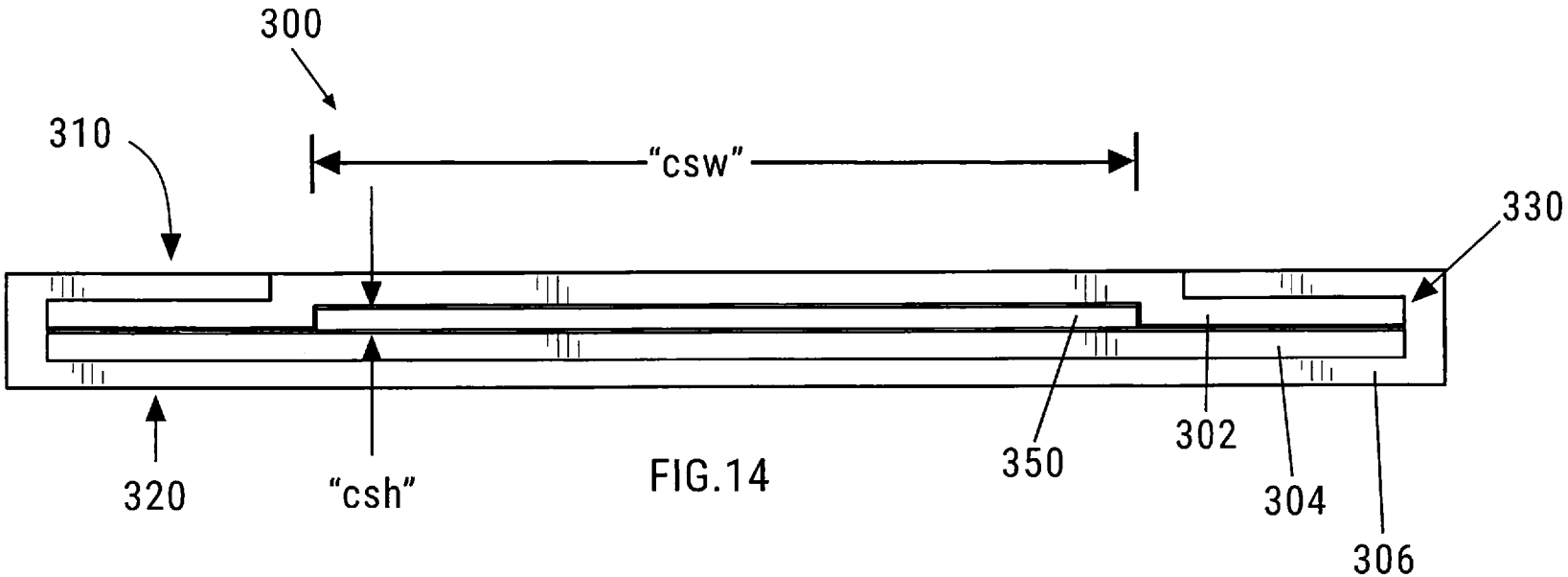
FIG. 14 is a front view of the jig of FIG. 13.
Figure 15:
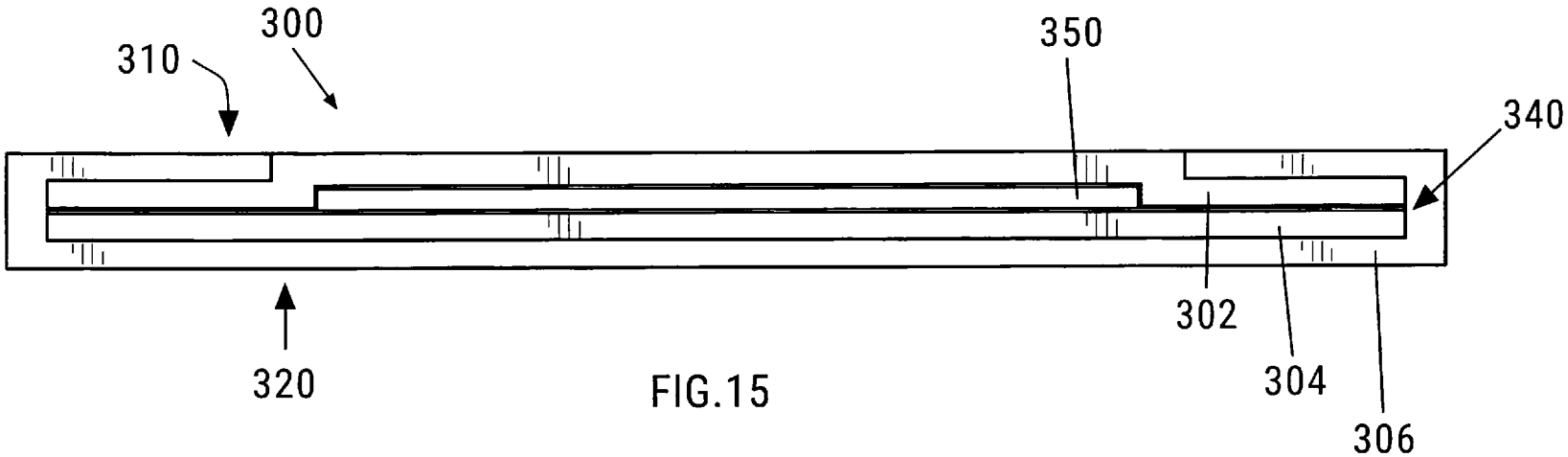
FIG. 15 is a rear view of the jig of FIG. 13.
Figure 17:
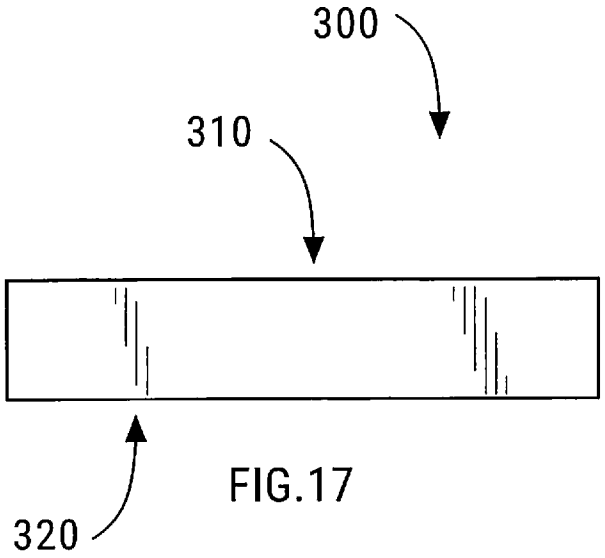
FIG. 17 is a left side view of the jig of FIG. 13.
Figure 16:
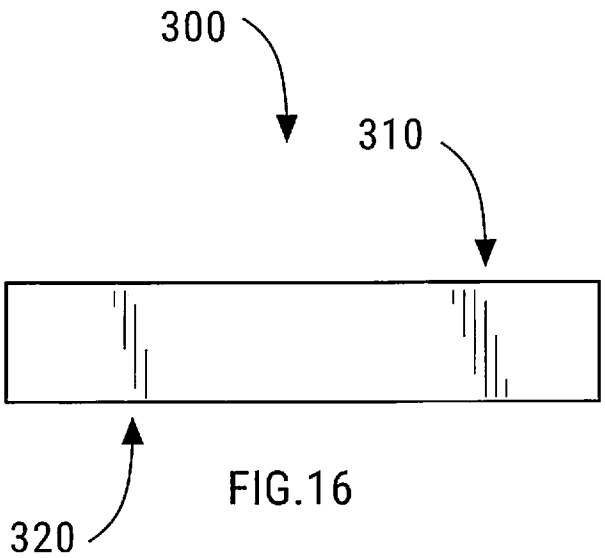
FIG. 16 is a right side view of the jig of FIG. 13.

With particular reference to FIGS. 13-15, various layers of the jig 300 are shown. (The layers of the jig 300 in FIGS. 1-4 are omitted for clarity.) In the illustrated embodiment, the jig 300 includes a first layer 302, a second layer 304, and a third layer 306. In embodiments, the first layer 302, which includes the alignment marks 370, is made from plastic (e.g., ABS or Acrylonitrile butadiene styrene, which is a thermoplastic polymer). The first layer 302 may be transparent, translucent, or opaque. In embodiments, the second layer 304 is made from steel, and the third layer 306 is made from rubber (e.g., a thermoplastic polymer or a thermoplastic rubber).

As shown in the illustrated embodiment, the rubber may be injection molded through a portion of the first layer 302 and through a portion of the second layer 304, which are both suitable to accommodate such injection molding. Such as injection molding process helps maintain the three layers 302, 304, 306 in place relative to each other during the stamping process. The third layer 306 being made from rubber also helps increase friction between the jib 300 and the surface on which it lays, which minimizes movement therebetween during the stamping process, thereby resulting in more accurate, deeper, and more even impressions on the card 200. Additionally, the rubber of the third layer 306 helps to dampen the noise created during the stamping process.

With reference to FIGS. 20-26, the first hammer 500*a* is shown. While various elements of the first hammer 500*a* are shown as a single unit, the present disclosure is intended to encompass various features of the first hammer 500*a*, individually in addition to as a whole. For instance, a handle 510*a* of the first hammer 500*a*, and portions thereof, are encompassed by the present disclosure. Additionally, a hammer head 520*a* of the first hammer 500*a*, and portions thereof, are encompassed by the present disclosure. For instance, the hammer head 520*a* includes a transparent or translucent portion 522*a*, which enables a slug 524*a* therein to be visible. In the illustrated embodiment, the slug 524*a* also extends beyond the transparent or translucent portion 522*a*. In embodiments, the first hammer 500*a* weighs 4 oz or approximately 4 oz.

With reference to FIGS. 27-33, the second hammer 500*b* is shown. While various elements of the second hammer 500*b* are shown as a single unit, the present disclosure is intended to encompass various features of the second hammer 500*b*, individually in addition to as a whole. For instance, a handle 510*b* of the second hammer 500*b*, and portions thereof, are encompassed by the present disclosure. Additionally, a hammer head 520*b* of the second hammer 500*b*, and portions thereof, are encompassed by the present disclosure. For instance, the hammer head 520*b* includes a transparent or translucent portion 522*b*, which enables a slug 524*b* therein to be visible. In the illustrated embodiment, the slug 524*b* also extends beyond the transparent or translucent portion 522*b*. In embodiments, the second hammer 500*b* weighs 1 lb. or approximately 1 lb.

With reference to FIGS. 34-40, the third hammer 500*c* is shown. While various elements of the third hammer 500*c* are shown as a single unit, the present disclosure is intended to encompass various features of the third hammer 500*c*, individually in addition to as a whole. For instance, a handle 510*c* of the third hammer 500*c*, and portions thereof, are encompassed by the present disclosure. Additionally, a hammer head 520*c* of the third hammer 500*c*, and portions thereof, are encompassed by the present disclosure. For instance, the hammer head 520*c* includes a transparent or translucent portion 522*c*, which enables a slug 524*c* therein to be visible. In the illustrated embodiment, the slug 524*c* also extends beyond the transparent or translucent portion 522*c*. In embodiments, the third hammer 500*c* weighs 2 lb. or approximately 2 lb.

The present disclosure also includes methods of using the stamping kit 100, or components thereof, as discussed hereinabove.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A stamping kit, comprising:

a jig including an upper surface, a lower surface, a front surface, a rear surface, a card slot extending between the front surface and the rear surface, and a stamping slot extending between the upper surface and the card slot, the card slot defines a width and a height, the stamping slot defines a width and a length;

a card defining a width and a thickness, the card configured and dimensioned to slide within the card slot of the jig; and a plurality of stamps, each stamp of the plurality of stamps having a proximal end configured to be selectively engaged by a hammer, and a distal end having a character thereon, a distal portion of each stamp of the plurality of stamps is configured and dimensioned to enter the stamping slot of the jig.

2. The stamping kit according to claim 1, wherein the width of the card slot of the jig is approximately equal to the width of the card.

3. The stamping kit according to claim 1, wherein the height of the card slot of the jig is approximately equal to the thickness of the card.

4. The stamping kit according to claim 1, wherein a length of the distal portion of each stamp of the plurality of stamps is approximately equal to the length of the stamping slot of the jig.

5. The stamping kit according to claim 1, wherein the jig includes a plurality of alignment marks disposed on the upper surface adjacent the stamping slot.

6. The stamping kit according to claim 5, wherein each stamp of the plurality of stamps includes an alignment mark on the distal portion.

7. The stamping kit according to claim 5, wherein adjacent alignment marks are spaced a first distance apart from each other, wherein each stamp of the plurality of stamps defines a width, and wherein the first distance is less than the width of each stamp of the plurality of stamps.

8. The stamping kit according to claim 5, wherein adjacent alignment marks are spaced a first distance apart from each other, wherein each stamp of the plurality of stamps defines a width, and wherein the first distance is approximately equal to half of the width of each stamp of the plurality of stamps.

9. The stamping kit according to claim 1, wherein the jig includes between eight and 16 alignment marks disposed on the upper surface adjacent the stamping slot.

10. The stamping kit according to claim 1, wherein the jig includes a plastic layer, a steel layer, and a rubber layer.

11. The stamping kit according to claim 1, wherein an entirety of the card is made from titanium.

12. The stamping kit according to claim 11, wherein the thickness of the card is 2 mm.

13. The stamping kit according to claim 1, further comprising a hammer configured to individually engage the proximal end of each stamp of the plurality of stamps.

14. The stamping kit according to claim 1, wherein the card includes at least 12 enumerated lines.

15. A stamping kit, comprising:

a card;

a stamp; and a jig including an upper surface, a lower surface, a card slot and a stamping slot defining a height extending between the upper surface and the card slot, the card slot configured and dimensioned to allow the card to pass therethrough, the stamp configured to extend completely through the height of the stamping slot, the card slot being perpendicular to the stamping slot, wherein a distal portion of the stamp is configured and dimensioned to enter the stamping slot at multiple locations along a width of the stamping slot.

16. The stamping kit according to claim 15, wherein the card is made entirely from grade 3 commercial titanium.

17. The stamping kit according to claim 16, wherein the card is 2 mm thick, and wherein the card slot defines a height of about 2 mm.

18. The stamping kit according to claim 15, wherein the jig includes a plastic portion, a steel portion, and a rubber portion.

19. The stamping kit according to claim 18, wherein the rubber portion is overmolded through part of the plastic portion and through part of the steel portion.

20. The stamping kit according to claim 15, wherein the card defines a width of about 3 inches, and wherein the card slot of the jig defines a width of about 3 inches.

* * * * *